US011072170B2

(12) United States Patent
Satoh et al.

(10) Patent No.: US 11,072,170 B2
(45) Date of Patent: Jul. 27, 2021

(54) LIQUID DISCHARGE APPARATUS, LIQUID DISCHARGE METHOD, AND RECORDING MEDIUM

(71) Applicants: Nobuyuki Satoh, Kanagawa (JP); Kentaro Uehara, Kanagawa (JP)

(72) Inventors: Nobuyuki Satoh, Kanagawa (JP); Kentaro Uehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/578,074

(22) Filed: Sep. 20, 2019

(65) Prior Publication Data

US 2020/0101736 A1 Apr. 2, 2020

(30) Foreign Application Priority Data

Sep. 27, 2018 (JP) ..... JP2018-182882
Sep. 2, 2019 (JP) ..... JP2019-159768

(51) Int. Cl.
*B41J 2/14* (2006.01)
*B41J 2/165* (2006.01)
(Continued)

(52) U.S. Cl.
CPC ..... *B41J 2/14048* (2013.01); *B41J 2/16508* (2013.01); *B41J 2/2054* (2013.01)

(58) Field of Classification Search
CPC ... B41J 2/14048; B41J 2/16508; B41J 2/2054
See application file for complete search history.

(56) References Cited

U.S. PATENT DOCUMENTS 5,289,208 A 2/1994 Haselby
6,390,587 B1 5/2002 Subirada
(Continued)

FOREIGN PATENT DOCUMENTS

CN 1788998 A 6/2006
CN 1907712 A 2/2007
(Continued)

OTHER PUBLICATIONS

Chinese office action; Application CN201910903408.2; dated Oct. 12, 2020.
(Continued)

*Primary Examiner* — Jason S Uhlenhake
(74) *Attorney, Agent, or Firm* — Duft & Bornsen, PC

(57) ABSTRACT

A liquid discharge apparatus includes a recording head configured to discharge a liquid to form a pattern on a recording medium and a reading device configured to read the pattern. The apparatus further includes circuitry configured to form at least two first markers while moving the recording head relative to the recording medium in a head movement direction; form a second marker at one of positions of the at least two first markers, to form a pattern including a reference marker formed with one of the at least two first markers and a measurement marker in which the second marker is overlaid on another of the at least two first markers; and measure a distance between the reference marker and the measurement marker in the head movement direction based on information obtained by the reading device.

17 Claims, 20 Drawing Sheets

(51) Int. Cl.
*B41J 2/20* (2006.01)
*B41J 2/205* (2006.01)

(56) References Cited

U.S. PATENT DOCUMENTS

2007/0013732 A1 1/2007 Sakamoto et al.
2009/0316164 A1 12/2009 Takahashi et al.
2010/0225693 A1 9/2010 Sakurada et al.
2010/0231632 A1 9/2010 Kobayashi et al.
2011/0007112 A1 1/2011 Takei et al.
2011/0063352 A1 3/2011 Sakurada et al.
2011/0063356 A1 3/2011 Kobayashi et al.
2011/0148971 A1 6/2011 Suzuki et al.
2011/0205275 A1 8/2011 Kimura et al.
2011/0211031 A1 9/2011 Satoh et al.
2011/0228027 A1 9/2011 Okada et al.
2011/0298854 A1 12/2011 Sakurada et al.
2012/0069411 A1 3/2012 Satoh et al.
2012/0086747 A1* 4/2012 Terada ..... B41J 19/145 347/9
2012/0250040 A1 10/2012 Yamazaki
2014/0218754 A1 8/2014 Satoh et al.
2015/0158309 A1 6/2015 Fujii et al.
2015/0375498 A1 12/2015 Horikawa et al.
2016/0004202 A1 1/2016 Morita et al.
2016/0031250 A1 2/2016 Yokozawa et al.
2016/0171348 A1 6/2016 Satoh et al.
2016/0243866 A1 8/2016 Yokozawa et al.
2016/0347052 A1 12/2016 Kawarada et al.
2017/0272617 A1 9/2017 Satoh et al.
2017/0361605 A1 12/2017 Kawarada et al.
2018/0022124 A1* 1/2018 Onodera ..... B41J 2/2135 347/8
2018/0141329 A1* 5/2018 Aoyagi ..... B41J 29/13
2018/0141359 A1 5/2018 Kawarada et al.
2018/0147835 A1 5/2018 Nakamura et al.
2018/0236798 A1 8/2018 Kanai

FOREIGN PATENT DOCUMENTS

CN 102729621 A 10/2012
CN 108454235 A 8/2018
EP 3323623 A1 5/2018
JP 2014188822 A 10/2014
JP 2018-083405 5/2018
JP 2018083334 A 5/2018
JP 2018094821 A 6/2018

OTHER PUBLICATIONS

Chinese Office Action; Application 201910903408.2; dated May 6, 2021.

* cited by examiner

LIQUID DISCHARGE APPARATUS, LIQUID DISCHARGE METHOD, AND RECORDING MEDIUM

CROSS-REFERENCE TO RELATED APPLICATIONS

This patent application is based on and claims priority pursuant to 35 U.S.C. § 119(a) to Japanese Patent Application Nos. 2018-182882, filed on Sep. 27, 2018, and 2019-159768, filed on Sep. 2, 2019, in the Japan Patent Office, the entire disclosure of each of which is hereby incorporated by reference herein.

BACKGROUND

Technical Field

The present disclosure relates to a liquid discharge apparatus, a liquid discharge method, and a recording medium.

Description of the Related Art

Inkjet liquid discharge apparatuses discharge ink from nozzles of a recording head mounted on a carriage while moving the carriage back and forth in a main scanning direction and repeatedly convey, with a conveyance roller, a recording medium in a sub-scanning direction, thereby forming an image. In such a configuration, even when the apparatus is controlled to discharge ink to an identical position, it is possible that the position at which the ink lands on the recording medium differs between forward movement of the recording head and backward movement of the recording head. This positional deviation is called deviation in ink landing position.

The cause of such deviation in ink landing position is not limited to the difference in travel direction of the carriage that moves forward and backward. The deviation in ink landing position may be caused by, for example, an error in attachment position of the recording head to the carriage.

SUMMARY

According to an embodiment of this disclosure, a liquid discharge apparatus includes a recording head configured to discharge a liquid to form a pattern on a recording medium and a reading device configured to read the pattern. The apparatus further includes circuitry configured to form at least two first markers while moving the recording head relative to the recording medium in a head movement direction; form a second marker at one of positions of the at least two first markers, to form a pattern including a reference marker formed with one of the at least two first markers and a measurement marker in which the second marker is overlaid on another of the at least two first markers; and measure a distance between the reference marker and the measurement marker in the head movement direction based on information obtained by the reading device.

According to another embodiment, a liquid discharge method includes forming, with a liquid discharged from a recording head, at least two first markers while moving the recording head relative to a recording medium in a head movement direction; forming a second marker at one of positions of the at least two first markers, to form a pattern including a reference marker formed with one of the at least two first markers and a measurement marker in which the second marker is overlaid on another of the at least two first markers; reading, with a sensor, the pattern; and measure a distance between the reference marker and the measurement marker in the head movement direction based on information obtained by the reading.

Yet another embodiment provides a non-transitory recording medium storing a plurality of program codes which, when executed by one or more processors, causes the processors to perform the method described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
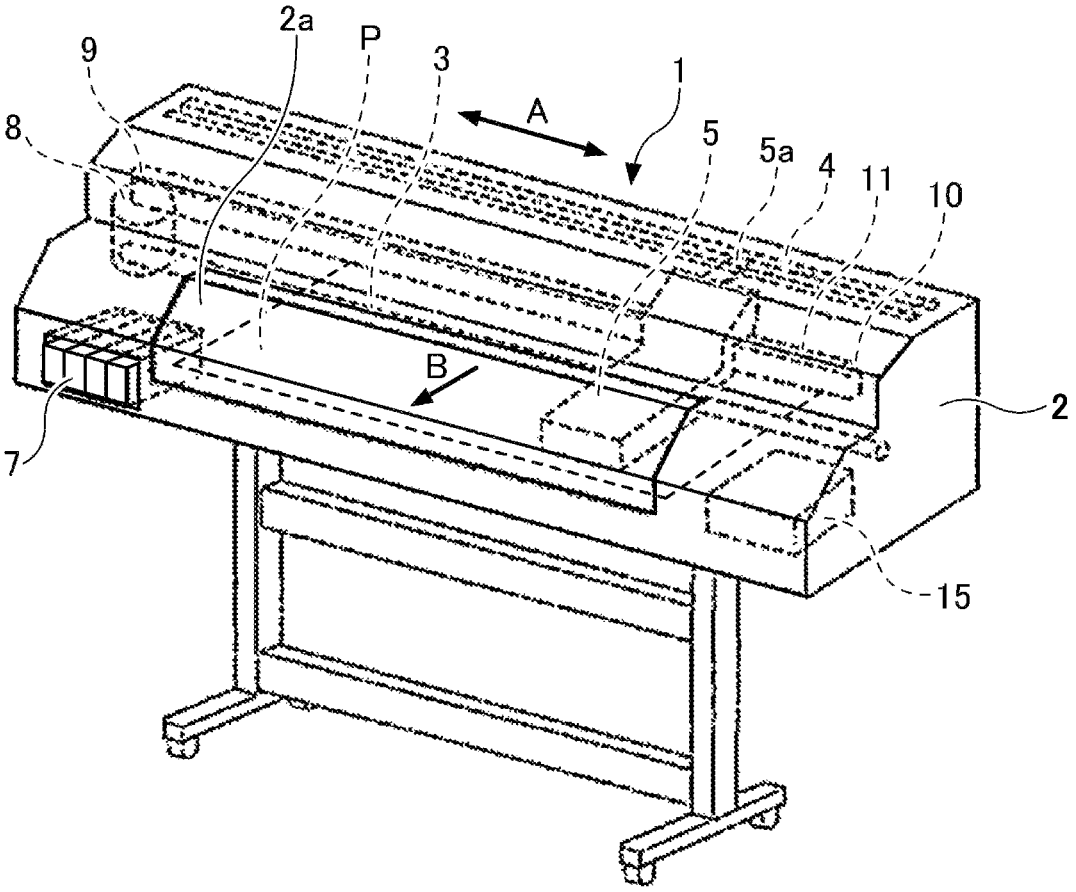
FIG. 1 is a schematic view illustrating a liquid discharge apparatus according to a first embodiment of the present disclosure.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a liquid discharge apparatus according to an embodiment of this disclosure is described. As used herein, the singular forms "a", "an", and "the" are intended to include the plural forms as well, unless the context clearly indicates otherwise.

The suffixes y, m, c, and k attached to each reference numeral indicate only that components indicated thereby are used for forming yellow, magenta, cyan, and black images, respectively, and hereinafter may be omitted when color discrimination is not necessary.

Embodiments according to the present disclosure are described in detail with reference to drawings. In each of the drawings, the same reference codes are allocated to components or portions having the same configuration and redundant descriptions of the same components may be omitted. In the embodiments described below, an inkjet printer configured to discharge ink onto a recording medium to form an image is an example of a liquid discharge apparatus to which aspects of this disclosure are applied.

First Embodiment

A description is given of a liquid discharge apparatus according to a first embodiment of the present disclosure.

Configuration of Liquid Discharge Apparatus

Figure 2:
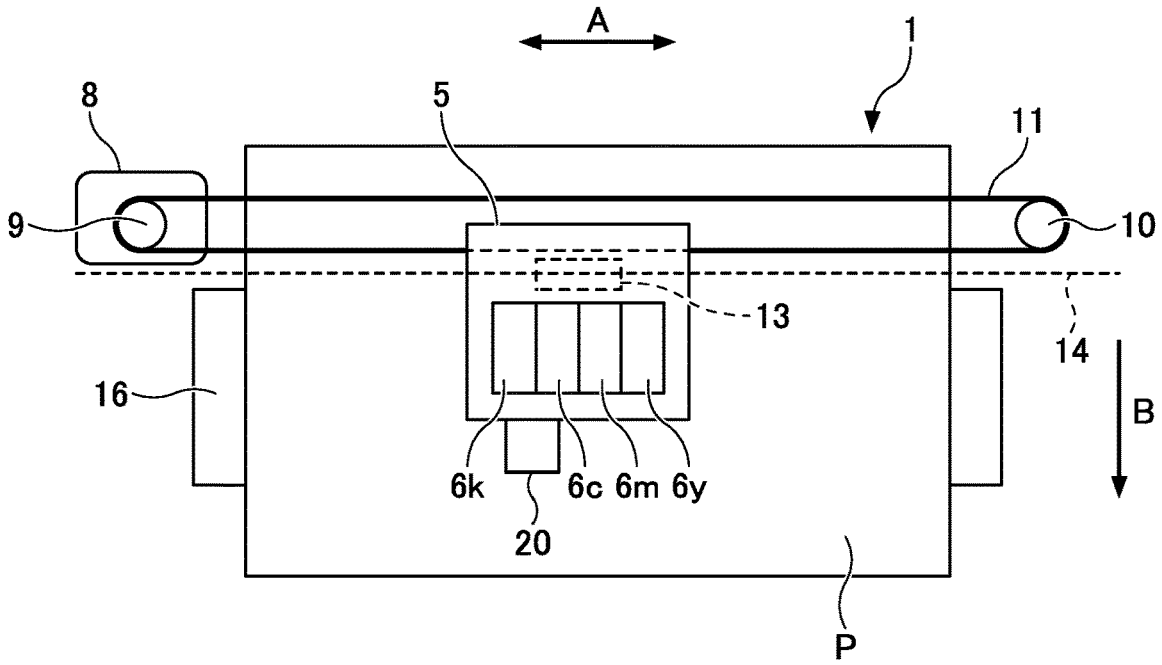
FIG. 2 is a top view illustrating an interior of the liquid discharge apparatus illustrated in FIG. 1.

FIG. 1 is a schematic view illustrating a liquid discharge apparatus 1 according to the first embodiment. In FIG. 1, the inside of the liquid discharge apparatus 1 is perspectively illustrated. FIG. 2 is a top view illustrating an interior of the liquid discharge apparatus 1.

As illustrated in FIG. 1, components of the liquid discharge apparatus 1 are disposed inside an enclosure 2. The enclosure 2 is provided with a cover 2*a* to open and close.

The liquid discharge apparatus 1 includes a carriage 5 that reciprocates in a main scanning direction (indicated by arrow A, hereinafter also "main scanning direction A") as a first direction (head movement direction). The carriage 5 is supported by a main guide rod 3 extending in the main scanning direction A. The carriage 5 includes a coupler 5*a*. The coupler 5*a* engages with a sub guide 4 disposed parallel to the main guide rod 3 and stabilizes the posture of the carriage 5.

The carriage 5 is coupled to a timing belt 11 extending between a driving pulley 9 and a driven pulley 10. The driving pulley 9 rotates, driven by a main scanning motor 8. The driven pulley 10 includes a mechanism to give a predetermined degree of tension to the timing belt 11 and adjust the distance to the driving pulley 9.

As the main scanning motor 8 drives the timing belt 11, the carriage 5 reciprocates in the main scanning direction A. For example, an encoder sensor 13 (see FIG. 2) is disposed on the carriage 5. The encoder sensor 13 detects a mark on an encoder sheet 14 (see FIG. 2) and outputs an encoder value. The amount and speed of travel of the carriage 5 are controlled based on the encoder value.

As illustrated in FIG. 2, recording heads 6*y*, 6*m*, 6*c*, and 6*k* are mounted on the carriage 5. The recording head 6*y* discharges yellow (Y) ink. The recording head 6*m* discharges magenta (M) ink. The recording head 6*c* discharges cyan (C) ink. The recording head 6*k* discharges black (Bk) ink. Hereinafter, the recording heads 6*y*, 6*m*, 6*c*, and 6*k* are collectively referred to as the recording heads 6.

The recording head 6 includes a nozzle plate having a nozzle face (discharge face) on which a plurality of nozzles 6*a* (see FIG. 8) are lined in a sub-scanning direction indicated by arrow B (hereinafter also "sub-scanning direction B"). The recording head 6 is supported by the carriage 5 so that the nozzle face faces a recording sheet P as a recording medium.

Further, the liquid discharge apparatus 1 is provided with a cartridge 7 (see FIG. 1). The cartridge 7, from which ink is supplied to the recording head 6, is not mounted on the carriage 5. The cartridge 7 is disposed at a predetermined position in the liquid discharge apparatus 1. The cartridge 7 and the recording head 6 are coupled with a pipe so that the ink is supplied through the pipe from the cartridge 7 to the recording head 6.

A platen 16 is provided at a position facing the discharge face of the recording head 6. The platen 16 supports the recording sheet P when ink is discharged from the recording head 6 onto the recording sheet P. The platen 16 includes many through holes penetrating in the thickness direction thereof and rib-shaped projections surrounding each of the through holes. A suction fan is disposed on a side of the platen 16 opposite the side on which the recording sheet P is supported. The suction fan inhibits the recording sheet P from dropping off from the platen 16. The recording sheet P is held between a conveyance roller pair and intermittently conveyed on the platen 16 in the sub-scanning direction indicated by arrow B, which is a second direction. The conveyance roller is driven by a sub-scanning motor 141 (see FIG. 4), the description of which is deferred. The second direction is orthogonal to the first direction.

The liquid discharge apparatus 1 intermittently conveys the recording sheet P in the sub-scanning direction B and reciprocates the carriage 5 in the main scanning direction A while the conveyance of the recording sheet P is stopped. During this reciprocal movement, the nozzles 6*a* of the recording heads 6 are selectively driven according to image data, thereby discharging the ink onto the recording sheet P on the platen 16. Thus, an image is formed on the recording sheet P.

Further, the liquid discharge apparatus 1 includes a maintenance mechanism 15 to maintain the reliability of the recording heads 6. For example, the maintenance mechanism 15 cleans the discharge faces of the recording heads 6, puts caps on the recording heads 6, and discharges unnecessary ink from the recording heads 6.

Configuration of Imaging Unit

Figure 3:
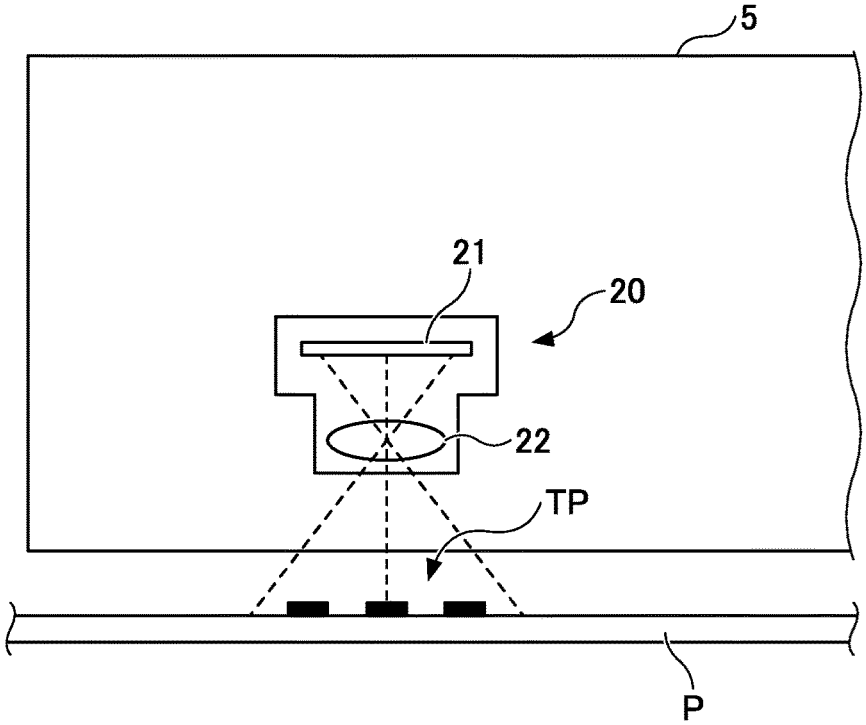
FIG. 3 is a view of an imaging unit mounted on a carriage of the liquid discharge apparatus illustrated in FIG. 1.

FIG. 3 is a view of an imaging unit 20 mounted on the carriage 5. The imaging unit 20 is mounted on the carriage 5 for capturing an image of a test pattern TP formed on the recording sheet P.

The imaging unit 20 includes a two-dimensional sensor 21 and an image forming lens 22. The two-dimensional sensor 21 is an image capture device such as a charge-coupled device (CCD) image sensor or a complementary metal oxide semiconductor (CMOS) image sensor. The image forming lens 22 forms, on a light-receiving face of the two-dimensional sensor 21, an optical image of the test pattern TP on the recording sheet P. The imaging unit 20 converts, with the two-dimensional sensor 21, an optical image obtained from the recording sheet P through the image forming lens 22 into an electrical signal and outputs the electrical image as a captured image of the test pattern TP.

For example, the imaging unit 20 is attached to a side face of the carriage 5 in a state where the optical axis of the image forming lens 22 is perpendicular to the surface of the recording sheet P set on the platen 16. Note that, as long as the imaging unit 20 can capture the test pattern TP on the recording sheet P, it is not necessary that the imaging unit 20 is mounted on the carriage 5.

Further, the imaging unit 20 includes a central processing unit (CPU), which is hereinafter referred to as a two-dimensional sensor CPU 23 (2-D sensor CPU 23 in FIG. 4). The two-dimensional sensor CPU 23 controls the two-dimensional sensor 21 and performs processing on the image captured by the two-dimensional sensor 21.

Hardware Configuration of Liquid Discharge Apparatus

Figure 4:
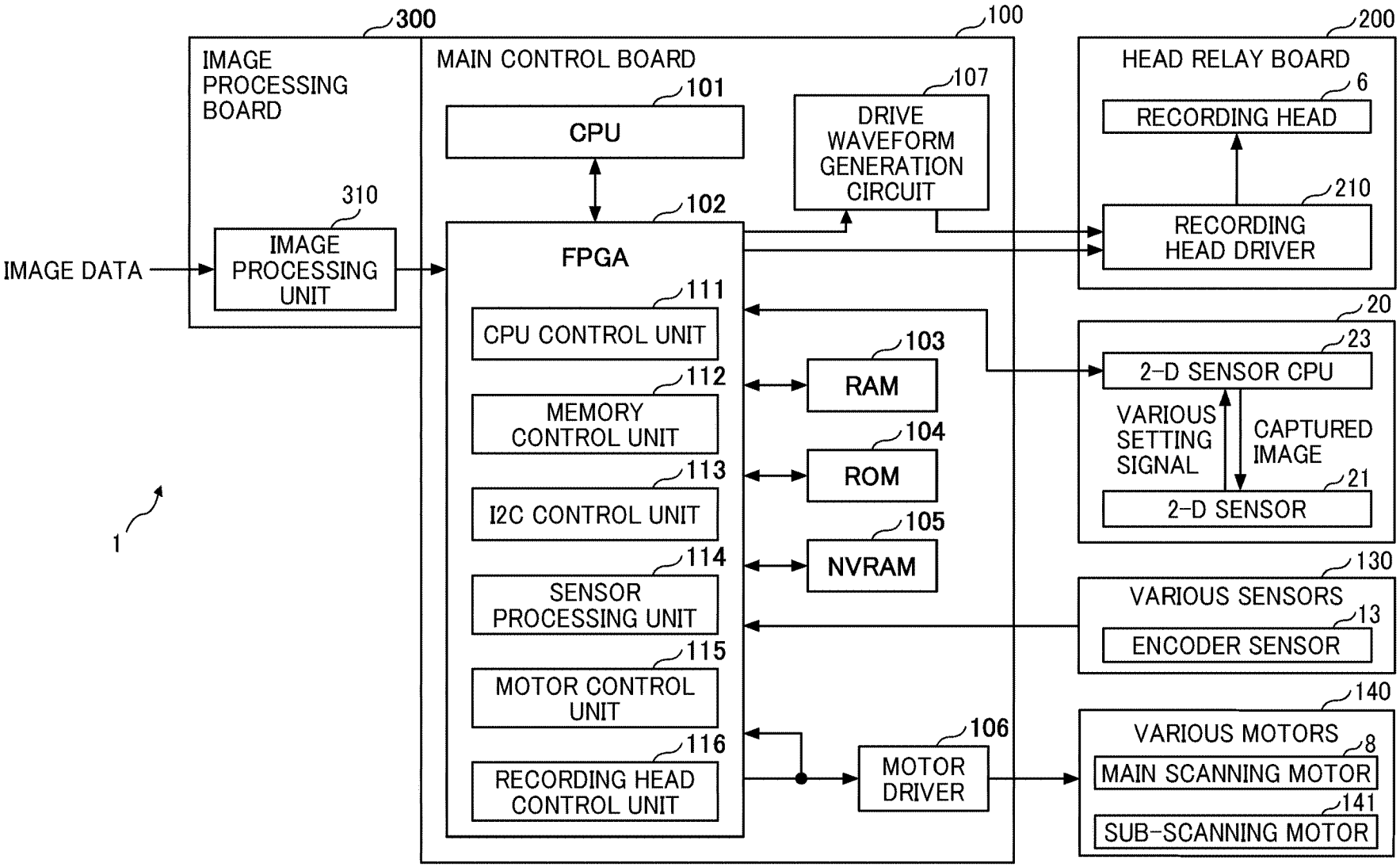
FIG. 4 is a block diagram illustrating an example of a hardware configuration of the liquid discharge apparatus.

FIG. 4 is a block diagram illustrating an example of a hardware configuration of the liquid discharge apparatus 1. The liquid discharge apparatus 1 includes a main control board 100, a head relay board 200, and an image processing board 300.

On the main control board 100, a CPU 101, a field-programmable gate array (FPGA) 102, a random access memory (RAM) 103, a read only memory (ROM) 104, a non-volatile random access memory (NVRAM) 105, a motor driver 106, a drive waveform generation circuit 107, and the like are mounted.

The CPU 101 controls the entire liquid discharge apparatus 1. For example, the CPU 101 uses the RAM 103 as a work area to execute various control programs stored on the ROM 104 in order to output a control command to control each operation in the liquid discharge apparatus 1. At this time, while communicating with the FPGA 102, the CPU 101 cooperates with the FPGA 102 to control various operations in the liquid discharge apparatus 1.

In particular, in the liquid discharge apparatus 1, the CPU 101 implements formation of the test pattern TP, acquisition of information of deviation amount in image formation based on a measured distance (an interval) between markers included in the test pattern TP, and outputting the information of deviation amount. Detailed descriptions of those functions are deferred.

A CPU control unit 111 has a capability to communicate with the CPU 101. A memory control unit 112 has a capability to access the RAM 103 and the ROM 104. An inter-integrated circuit (I2C) control unit 113 has a capability to communicate with the NVRAM 105.

A sensor processing unit 114 processes sensor signals from various sensors 130. The term "various sensors 130" is a generic term representing sensors that detect various states in the liquid discharge apparatus 1. In addition to the encoder sensor 13, the various sensors 130 includes a sheet sensor to detect the passage of a recording sheet, a cover sensor to detect opening of the cover 2*a*, a temperature and humidity sensor to detect ambient temperature and humidity, a sensor to detect the state of a lever to secure the recording sheet P, and an ink amount sensor to detect the amount of ink remaining in the cartridge 7. Note that an analog sensor signal output from the temperature and humidity sensor or the like is converted into a digital signal by an analog-to-digital (AD) converter mounted, for example, on the main control board 100 and input to the FPGA 102.

A motor control unit 115 controls various motors 140. The term "various motors 140" are generic names for the motors included in the liquid discharge apparatus 1. The various motors 140 includes the main scanning motor 8 to drive the carriage 5, the sub-scanning motor 141 to convey the recording sheet P in the sub-scanning direction, a sheet feeding motor to feed the recording sheet P, and a maintenance motor to drive the maintenance mechanism 15.

Descriptions are given below of control of the main scanning motor 8, as an example control by cooperation between the CPU 101 and the motor control unit 115 of the FPGA 102. First, the CPU 101 notifies the motor control unit 115 of an instruction to start operation of the main scanning motor 8 and the travel speed and the travel distance of the carriage 5. In response to a reception of such an instruction, the motor control unit 115 generates a drive profile, based on the travel speed and information on the operation start instruction notified from the CPU 101, calculates a pulse-width modulation (PWM) command value while performing comparing with an encoder value supplied from the sensor processing unit 114 (obtained from processing of the sensor signal from the encoder sensor 13), and outputs the PWM command value to the motor driver 106. Upon completion of the predetermined operation, the motor control unit 115 notifies the CPU 101 of the completion of the operation.

Although the description above concerns the example in which the motor control unit 115 generates the drive profile, alternatively, the CPU 101 can be configured to generate the drive profile and transmit an instruction to the motor control unit 115. Further, the CPU 101 counts the number of printed sheets, the number of scanning of the main scanning motor 8, and the like.

A recording head control unit 116 transmits head drive data, a discharge synchronization signal LINE, and a discharge timing signal CHANGE stored in the ROM 104 to the drive waveform generation circuit 107 to cause the drive waveform generation circuit 107 to generate a common drive waveform signal Vcom. The common drive waveform signal Vcom generated by the drive waveform generation circuit 107 is input to a recording head driver 210 to be described later, mounted on the head relay board 200.

The two-dimensional sensor CPU 23 controls the two-dimensional sensor 21 and processes the image captured by the two-dimensional sensor 21 based on an operation instruction from the CPU 101 or the FPGA 102. In specific, the two-dimensional sensor CPU 23 transmits various setting signals to the imaging unit 20 in order to determine various operation settings under which the two-dimensional sensor 21 operates. In addition, the two-dimensional sensor CPU 23 implements measurement of the distance between markers in the test pattern TP based on the captured image of the test pattern TP, calculation of an interval ratio, and the like. Detailed descriptions of those functions are deferred.

Hardware Configuration of Image Processing Unit

Figure 5:
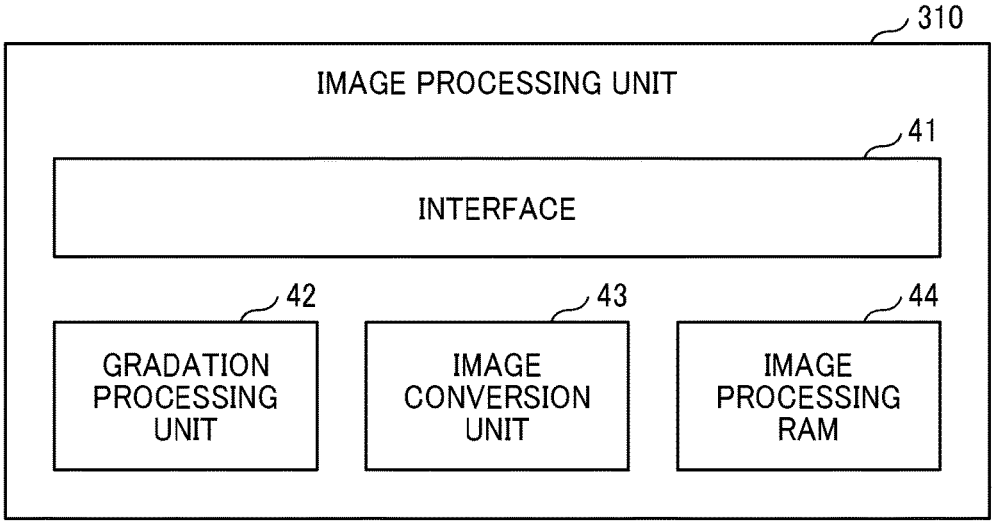
FIG. 5 is a block diagram illustrating an example configuration of an image processing unit according to an embodiment.

FIG. 5 is block diagram illustrating an example of a functional configuration of an image processing unit 310 implemented on the image processing board 300.

The image processing unit 310 performs gradation processing, image conversion processing, and the like on the received image data and converts the received image data into image data in a format that can be processed by the recording head control unit 116. Then, the image processing unit 310 outputs the converted image data to the recording head control unit 116.

More specifically, the image processing unit 310 includes an interface 41, a gradation processing unit 42, an image conversion unit 43, and an image processing RAM 44. The interface 41 is an input device to input image data and is a communication interface with the CPU 101 and the FPGA 102. The gradation processing unit 42 performs gradation processing on accepted multivalued image data and converts the image data into small-value image data. The small-value image data is image data of a gradation number equal to the type (large droplet, medium droplet, and small droplet) of the droplets discharged by the recording head 6. Then, the gradation processing unit 42 holds the converted image data for one band or more on the image processing RAM 44.

The image data for one band represents image data corresponding to the maximum width in the sub-scanning direction B that the recording head 6 can record in one scanning in the main scanning direction.

The image conversion unit 43 converts the image data of one band on the image processing RAM 44 in a unit of image to be output in one scanning in the main scanning direction. This conversion is performed in accordance with the configuration of the recording head 6, according to the information of the printing order and the printing width (the width of image recording per scanning in the sub-scanning direction) received from the CPU 101 via the interface 41.

The printing order and the printing width can be one-pass printing in which an image is formed in one scanning in the main scanning direction on the recording sheet P, or, alternatively, multi-pass printing in which an image is formed in a plurality of times of scanning in the main scanning direction in the same area of the recording sheet P using the same nozzle group or different nozzle groups. Alternatively, a plurality of heads can be arrayed in the main scanning direction to discharge liquid to the same area with different nozzles 6*a*. These recording methods can be appropriately combined.

The term "printing width" is the width of the image in the sub-scanning direction B to be printed in one scan of the recording head 6 in the main scanning direction. The CPU 101 sets the print width.

The image conversion unit 43 outputs the converted image data SD' to the recording head control unit 116 via the interface 41.

The function of the image processing unit 310 can be executed by hardware such as an FPGA or ASIC or by an image processing program stored in a memory inside the image processing unit 310. In addition, the function of the image processing unit 310 can be implemented not by an internal configuration of the liquid discharge apparatus 1 but by software installed on a computer.

Example Configuration of Recording Head Driver

Figure 6:
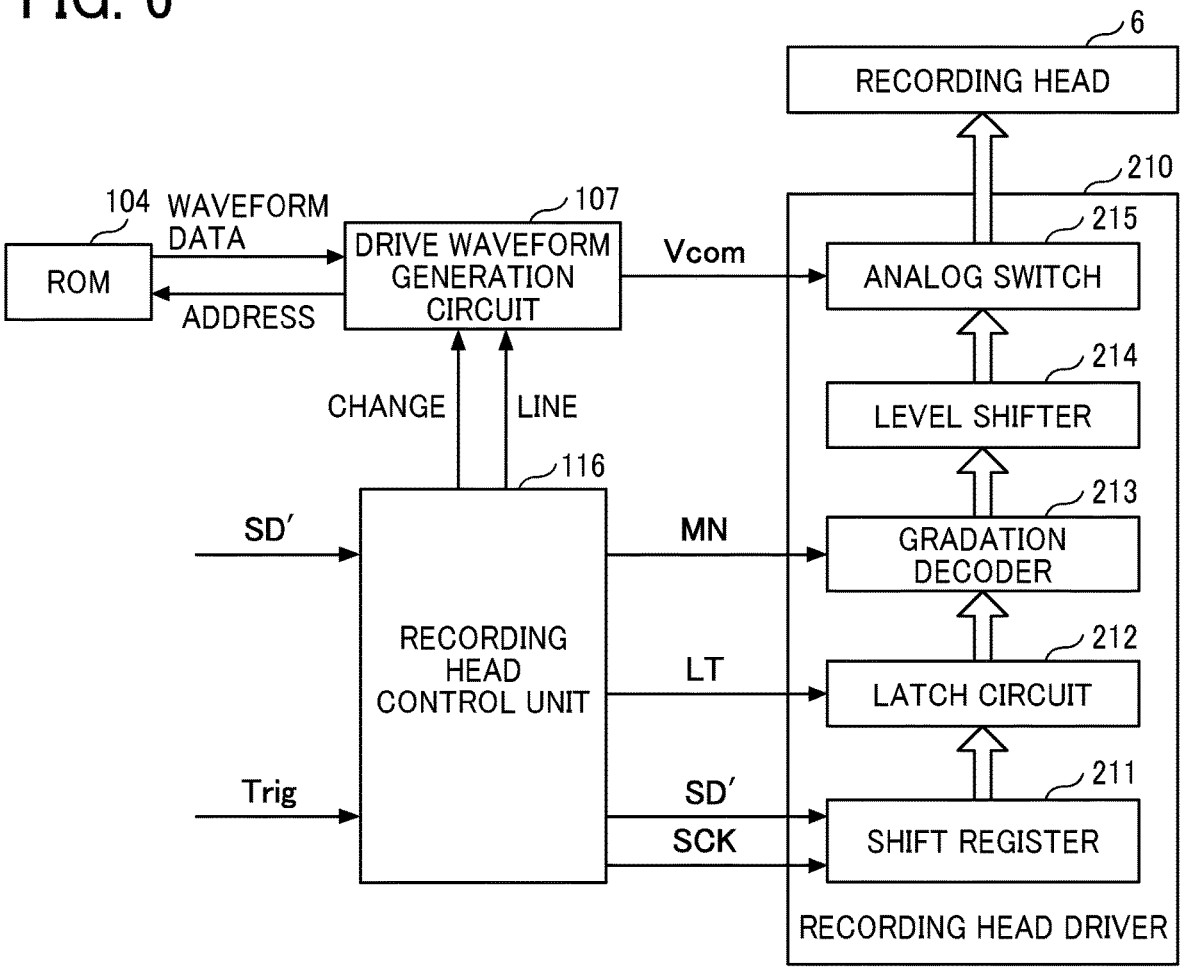
FIG. 6 is a block diagram illustrating an example of configurations of a recording head control unit, a drive waveform generation circuit, and a recording head driver of the liquid discharge apparatus.

FIG. 6 is a block diagram illustrating an example of configurations of the recording head control unit 116, the drive waveform generation circuit 107, and the recording head driver 210.

In response to a reception of a trigger signal Trig that triggers liquid discharging, the recording head control unit 116 outputs the discharge synchronization signal LINE that triggers generation of the drive waveform, to the drive waveform generation circuit 107. Further, the recording head control unit 116 outputs a discharge timing signal CHANGE equivalent to the amount of delay from the discharge synchronization signal LINE, to the drive waveform generation circuit 107. The drive waveform generation circuit 107 generates a common drive waveform signal Vcom at the timing based on the discharge synchronization signal LINE and the discharge timing signal CHANGE.

Further, the recording head control unit 116 receives the image data SD' after the image processing from the image processing unit 310, and, based on the image data SD', generates a mask control signal MN. The mask control signal MN is for selecting a waveform of the common drive waveform signal Vcom according to the size of the ink droplet to be discharged from each nozzle 6*a* of the recording head 6. The mask control signal MN is a signal synchronized with the discharge timing signal CHANGE. Then, the recording head control unit 116 transmits the image data SD', a synchronization clock signal SCK, a latch signal LT instructing latch of the image data, and the generated mask control signal MN to the recording head driver 210.

The recording head driver 210 includes a shift register 211, a latch circuit 212, a gradation decoder 213, a level shifter 214, and an analog switch 215.

The shift register 211 receives the image data SD' and the synchronization clock signal SCK transmitted from the recording head control unit 116. The latch circuit 212 latches each value on the shift register 211 according to the latch signal LT transmitted from the recording head control unit 116.

The gradation decoder 213 decodes the value (the image data SD') latched by the latch circuit 212 and the mask control signal MN and outputs the result. The level shifter 214 converts the level of a logic level voltage signal of the gradation decoder 213 to a level at which the analog switch 215 can operate.

The analog switch 215 is turned on and off by the output received from the gradation decoder 213 via the level shifter 214. The analog switch 215 is provided for each nozzle 6*a* of the recording head 6 and is connected to an individual electrode of a piezoelectric element corresponding to each nozzle 6*a*. In addition, to the analog switch 215, the common drive waveform signal Vcom from the drive waveform generation circuit 107 is input. In addition, as described above, the timing of the mask control signal MN is synchronized with the timing of the common drive waveform signal Vcom.

Therefore, the analog switch 215 is switched between on and off timely in accordance with the output from the gradation decoder 213 via the level shifter 214. With this operation, the waveform to be applied to the piezoelectric element corresponding to each nozzle 6*a* is selected from the drive waveforms forming the common drive waveform signal Vcom. As a result, the size of the liquid droplet discharged from the nozzle 6*a* is controlled.

Configuration Relating to Landing Position Deviation Detection

Next, functions relating to landing position deviation detection implemented by the CPU 101 and the two-dimensional sensor CPU 23 of the liquid discharge apparatus 1 are described.

Figure 7:
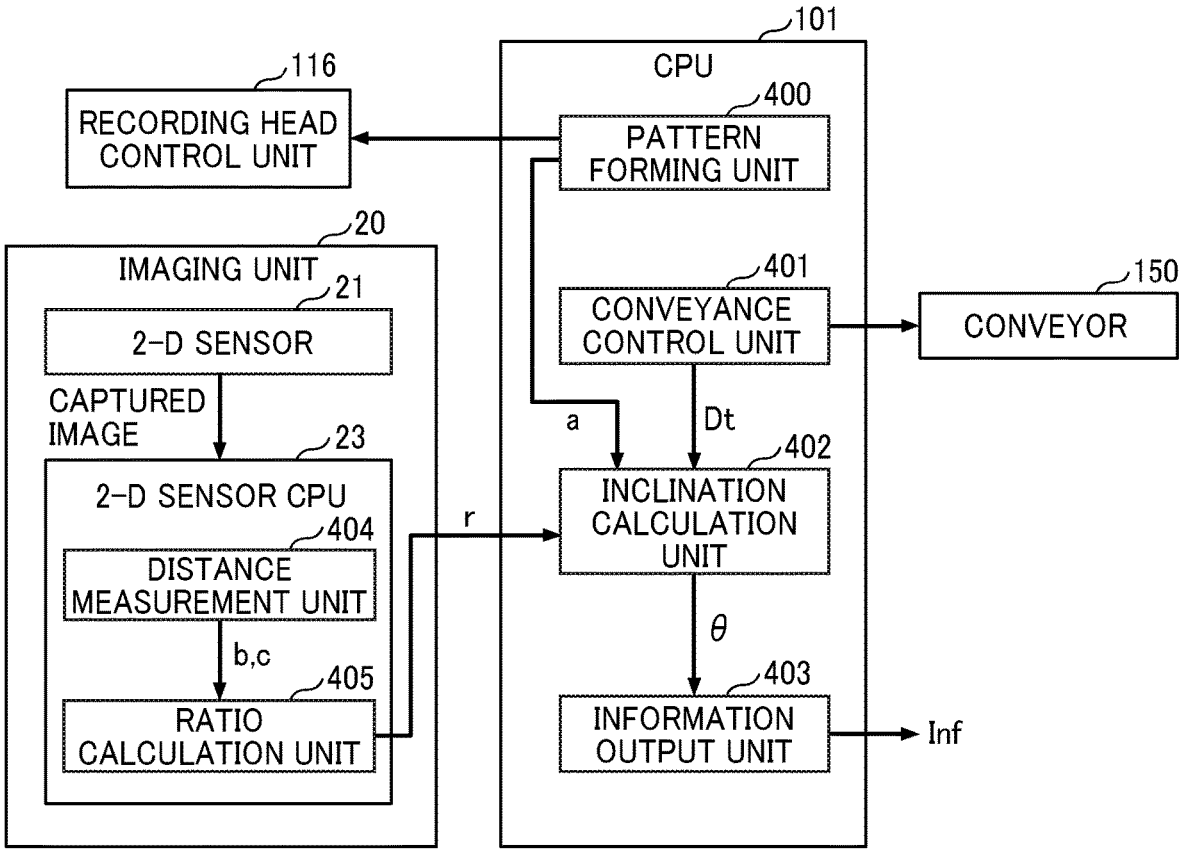
FIG. 7 is a block diagram illustrating a functional configuration relating to detection of deviations in landing position.

FIG. 7 is a block diagram illustrating a functional configuration relating to detection of deviations in landing position. In the present embodiment, the tilt of the recording head 6 relative to the carriage 5 due to an attachment error of the recording head 6 can be detected based on the ink landing position.

For example, the CPU 101 executes a control program stored in the ROM 104, using the RAM 103 as a work area, thereby implementing the functions of a pattern forming unit 400, a conveyance control unit 401, an inclination calculation unit 402, an information output unit 403, and the like.

The two-dimensional sensor CPU 23 executes a control program stored on the ROM using, for example, the RAM as a work area, thereby implementing the functions of a distance measurement unit 404, a ratio calculation unit 405, and the like. Alternatively, the distance measurement unit 404 and the ratio calculation unit 405 may be implemented in the CPU 101.

The conveyance control unit 401 controls the sub-scanning motor 141 (a conveyor 150) for conveying the recording sheet P in the sub-scanning direction B via the motor control unit 115 and the motor driver 106 described above. For example, the conveyance control unit 401 determines the rotation speed and rotation direction of the conveyance roller based on the encoder value output from the encoder sensor 13. Then, the conveyance control unit 401 transmits a control command indicating the determined rotation speed and rotation direction to the motor control unit 115, thereby controlling the conveyor 150 (a medium conveyor) to convey the recording sheet P. The conveyor 150 includes the above-described sub-scanning motor 141 and conveyance rollers.

The pattern forming unit 400 reads pattern data stored in advance in the above-described ROM 104 or the like. The pattern forming unit 400 causes the recording head 6 and the conveyor 150 to perform an image forming operation, in cooperation, corresponding to the pattern data, thereby forming a test pattern TP on the recording sheet P. The two-dimensional sensor 21 captures an image of the test pattern TP on the recording sheet P. The pattern forming unit 400 can be a functional unit implemented in an external personal computer (PC) connected to the liquid discharge apparatus 1, not limited to the CPU 101.

The test pattern TP of the present embodiment includes at least one reference marker and one measurement marker. A detailed description of the test pattern TP is deferred.

The distance measurement unit 404 measures the interval (distance) between the reference marker and the measurement marker in the main scanning direction based on the image of the test pattern TP captured by the two-dimensional sensor 21, that is, information obtained by the reading device. For example, one of a pair of measurement markers sandwiching the reference marker is referred to as a first measurement marker, and the other is referred to as a second measurement marker. In this case, the distance measurement unit 404 measures a distance b (a first distance) between the reference marker and the first measurement marker and a distance c (a second distance) between the reference marker and the second measurement marker. Each measured value is, for example, a value in a unit of one pixel of the captured image.

The ratio calculation unit 405 calculates a ratio r between the distance b and the distance c measured by the distance measurement unit 404 and sends the calculated ratio r to the inclination calculation unit 402.

The pattern forming unit 400 provides an ideal value a of the distance between the reference marker and the measurement marker. The inclination calculation unit 402 calculates an inclination angle θ of the recording head 6 based on the ideal value a, a conveyance distance (movement amount) Dt in the sub-scanning direction B of the recording sheet P in formation of the test pattern TP, and the ratio r acquired from the ratio calculation unit 405. In other words, the inclination angle θ is calculated using the set value of the pitch (interval) of the first markers M1, the conveyance distance (movement amount) Dt, and the ratio r. The inclination calculation unit 402 outputs the calculated inclination angle θ to the information output unit 403.

The information output unit 403 sends information Inf representing the inclination angle θ to a panel display section of the liquid discharge apparatus 1, a PC connected to the liquid discharge apparatus 1, or the like.

Test Pattern Formation and Deviation Detection

Next, the formation of the test pattern TP and the deviation detection operation are described with reference to FIGS. 8 to 12. Referring to FIGS. 9 and 11, a reference marker Ks and a measurement marker Km included in the test pattern TP are constructed of a first marker M1 formed by a first nozzle group and a second marker M2 formed by a second nozzle group. The first marker M1 and the second marker M2 have linear shapes extending in the sub-scanning direction B.

Figure 8:
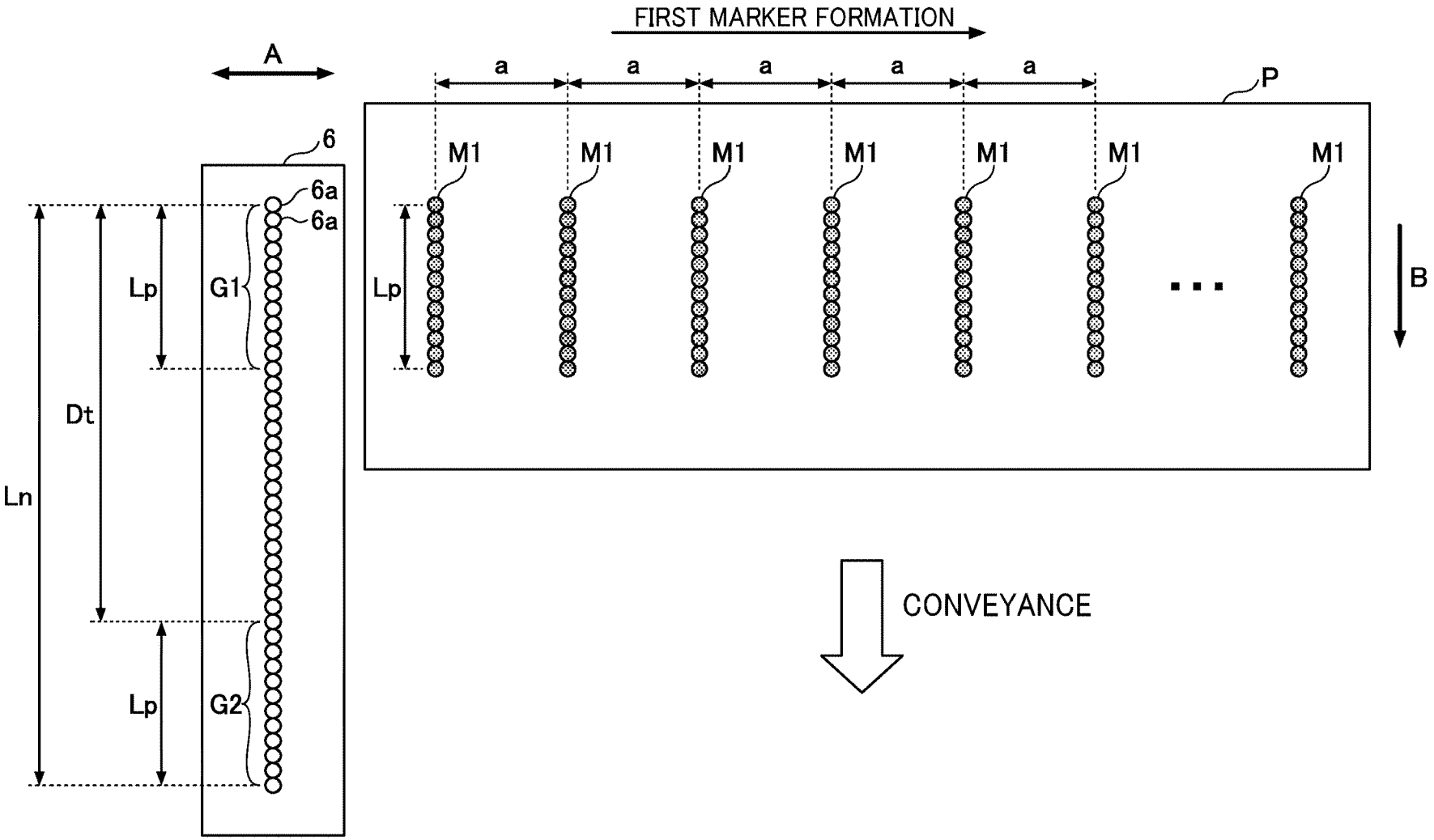
FIG. 8 is a diagram illustrating a first marker forming operation according to the first embodiment.
Figure 9:
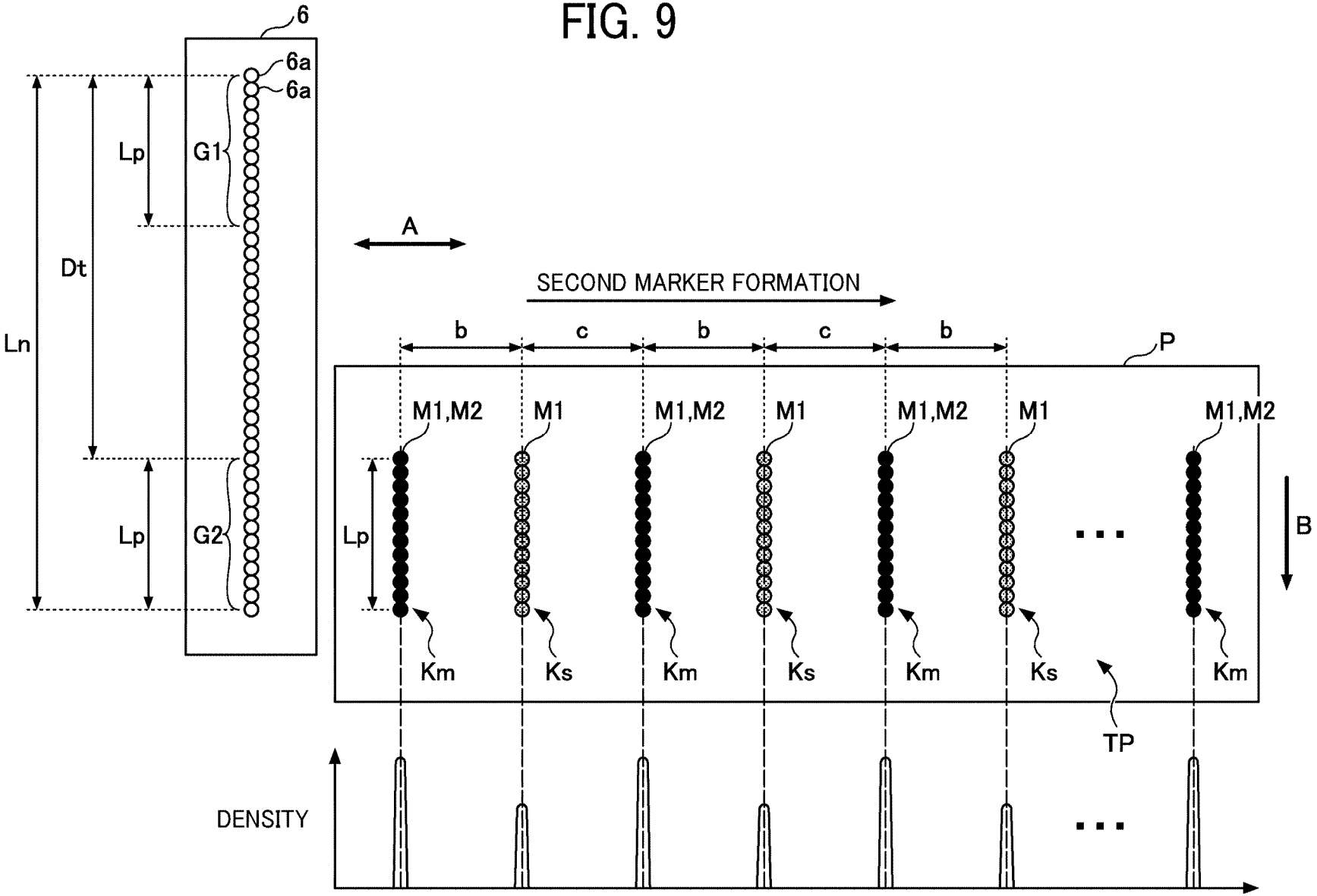
FIG. 9 is a diagram illustrating a second marker forming operation according to the first embodiment.

FIG. 8 is a diagram illustrating formation of the first markers M1. FIG. 9 is a diagram illustrating formation of the second markers M2. As illustrated in FIGS. 8 and 9, the recording head 6 has a plurality of nozzles 6*a* lined in the sub-scanning direction B. Here, a nozzle row constructed of the plurality of nozzles 6*a* has a total length Ln in the sub-scanning direction B.

Note that, in the structure in which the plurality of recording heads 6*y*, 6*m*, 6*c*, and 6*k* of different colors are mounted on the carriage 5, a plurality of nozzle rows are arranged side by side in the main scanning direction A, but only one nozzle row is illustrated in FIGS. 8 and 9 for the sake of simplicity. The test pattern TP is formed by, for example, a nozzle row of the recording head 6*k* that discharges black (B) ink. The color of the ink forming the test pattern TP is not limited to black but may be another color. It is preferable to use an ink having the highest contrast with the color of the recording sheet P.

In the present embodiment, the first marker M1 is formed using a first nozzle group G1 selected from the plurality of nozzles 6*a* constituting one nozzle row. The second marker M2 is formed using a second nozzle group G2.

The first nozzle group G1 is a nozzle row located on the rear end side (upstream side) in the sub-scanning direction B. The second nozzle group G2 is a nozzle row located on the front side (downstream side) in the sub-scanning direction B. In the present embodiment, the number of nozzles 6*a* in the first nozzle group G1 is the same as that in the second nozzle group G2, and both the first nozzle group G1 and the second nozzle group G2 have a length Lp in the sub-scanning direction B. The first nozzle group G1 and the second nozzle group G2 are not necessarily located at ends of the nozzle row. The first nozzle group G1 and the second nozzle group G2 may share one or more nozzles 6*a*.

Figure 12:
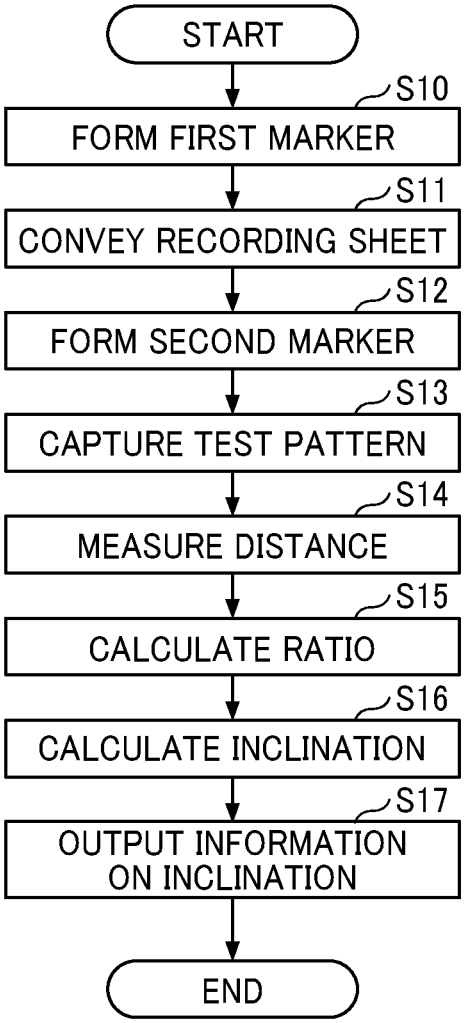
FIG. 12 is a flowchart of formation of a test pattern and detection of a deviation according to the first embodiment.

First, as illustrated in FIG. 8, while moving the recording head 6 from a predetermined start position to the positive side (forward direction) in the main scanning direction A, the pattern forming unit 400 causes the recording head 6 to discharge ink from the first nozzle group G1 to the recording sheet P, thereby forming the first markers M1 (S10 in FIG. 12). In the present embodiment, the pattern forming unit 400 forms the first markers M1 at a constant pitch in the main scanning direction A. In an ideal state in which no deviation is present in the ink landing position, the first markers M1 have the length Lp in the sub-scanning direction B and are formed at intervals (pitch) of the ideal value a in the main scanning direction A.

After forming the first markers M1, the pattern forming unit 400 moves the recording head 6 to the negative side in the main scanning direction A (return direction) to the start position, without performing the discharge operation.

Next, as illustrated in FIG. 9, the conveyance control unit 401 causes the conveyor 150 to convey the recording sheet P by a predetermined conveyance distance Dt (a predetermined movement amount) in the sub-scanning direction B (S11). In the present embodiment, the conveyance distance Dt is a value obtained by subtracting the length Lp of the first nozzle group G1 (or the second nozzle group G2) from the total length Ln of the plurality of nozzles 6*a*, that is, Dt=Ln−Lp.

Then, the pattern forming unit 400 causes the recording head 6 to discharge ink from the second nozzle group G2 to the recording sheet P while moving the recording head 6 from the predetermined start position to the positive side (forward direction) in the main scanning direction A, thereby forming the second marker M2 (S12). At this time, the pattern forming unit 400 forms the second markers M2 at positions reduced, with a predetermined thinning rate (for example, 2), from a plurality of positions where the first markers M1 are formed. In the present embodiment, the pattern forming unit 400 forms the second markers M2 with a pitch twice as large as that of the first marker M1 so that the second markers M2 overly over some of the first markers M1. In an ideal state in which there is no deviation in the ink landing position, the second markers M2 fully lap over some of the first markers M1.

As a result, the test pattern TP formed on the recording sheet P includes the reference marker Ks formed with the first marker M1 and the measurement marker Km in which the first marker M1 and the second marker M2 are overlaid.

The reference marker Ks and the measurement marker Km are alternately arranged in the main scanning direction A. That is, a pair of measurement markers Km sandwiching the reference marker Ks is formed.

The test pattern TP is captured by the two-dimensional sensor 21, and the captured image is input to the two-dimensional sensor CPU 23 (S13). The graph illustrated in FIG. 9 illustrates a density distribution of the captured image in the main scanning direction A. The measurement marker Km has a higher density than the reference marker Ks, which is a single line, because the first marker M1 and the second marker M2 are overlaid in the measurement marker Km. Thus, the pair of measurement markers Km can be easily distinguished from the reference marker Ks with the density difference even when the measurement markers Km and the reference marker Ks are same in shape.

The distance measurement unit 404 measures the distance between the reference marker Ks and the measurement marker Km based on the captured image (S14). The distance measurement unit 404 can identify a high-density line as the measurement marker Km and a low-density line as the reference marker Ks based on the density of the captured image. Additionally, the distance measurement unit 404 measures, as the distance, the distance between peaks in the main scanning direction A in the density distribution of the captured image.

Specifically, the distance measurement unit 404 selects one reference marker Ks, sets the measurement marker Km on the negative side of the selected reference marker Ks in the main scanning direction as the first measurement marker, and measures the distance b between the reference marker Ks and the first measurement marker. Further, the distance measurement unit 404 sets the measurement marker Km on the positive side of the reference marker Ks in the main scanning direction as the second measurement marker and measures the distance c between the reference marker Ks and the second measurement marker. The distance measurement unit 404 outputs the measured values of the distances b and c to the ratio calculation unit 405.

Preferably, the distance measurement unit 404 changes the selected reference marker Ks, measures the distances b and c based on each reference marker Ks, and outputs the average values of the distances b and c as measured values. Further preferably, the distance measurement unit 404 measures the distances b and c at a plurality of different positions in the sub-scanning direction B and uses an average of the measured values at the different positions.

Since FIGS. 8 and 9 illustrate an ideal state in which there is no deviation in the landing position of the ink due to the inclination of the recording head 6 and the like, each of the distances b and c has an ideal value a.

Figure 10:
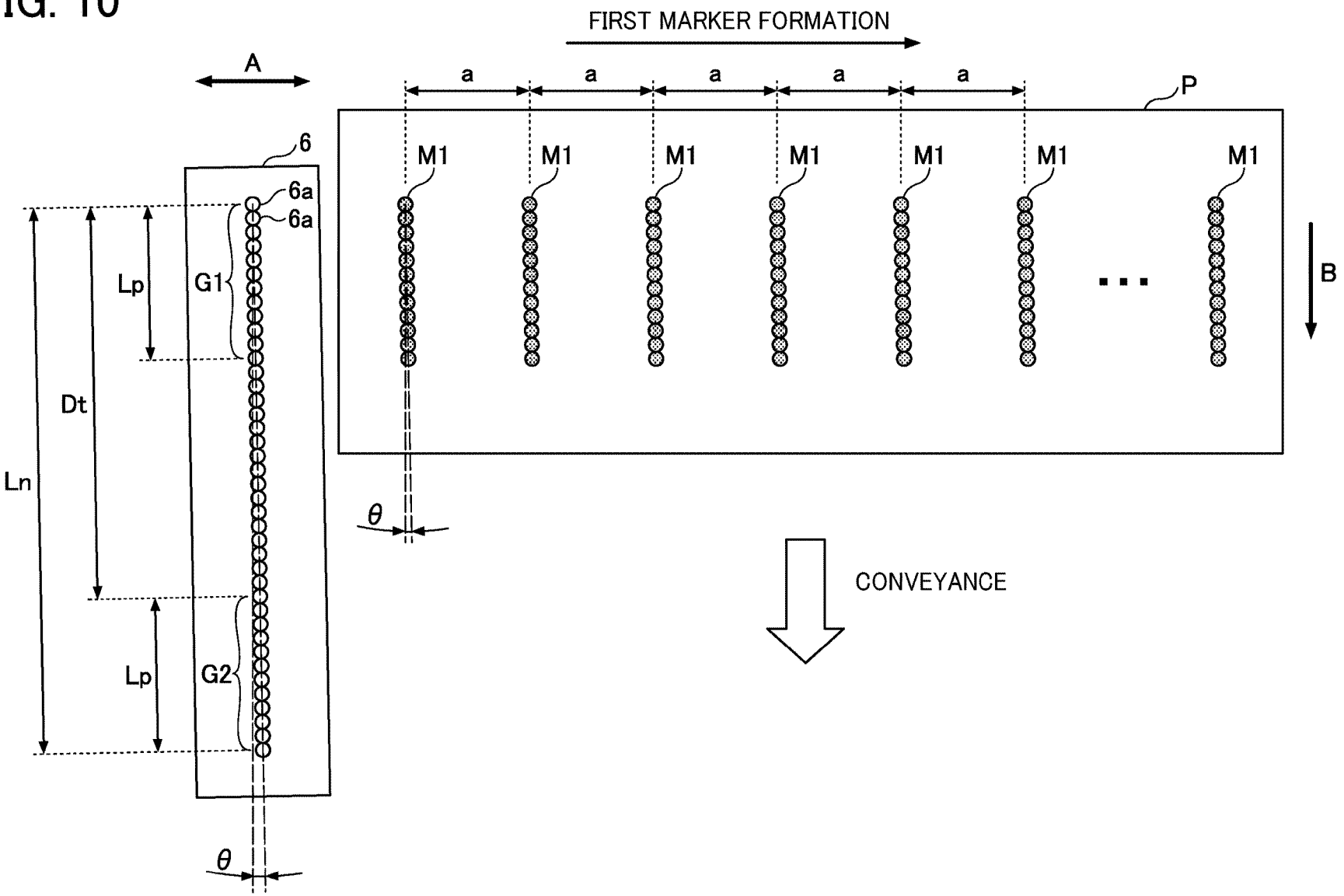
FIG. 10 is a diagram illustrating the first marker formed when a recording head is tilted.
Figure 11:
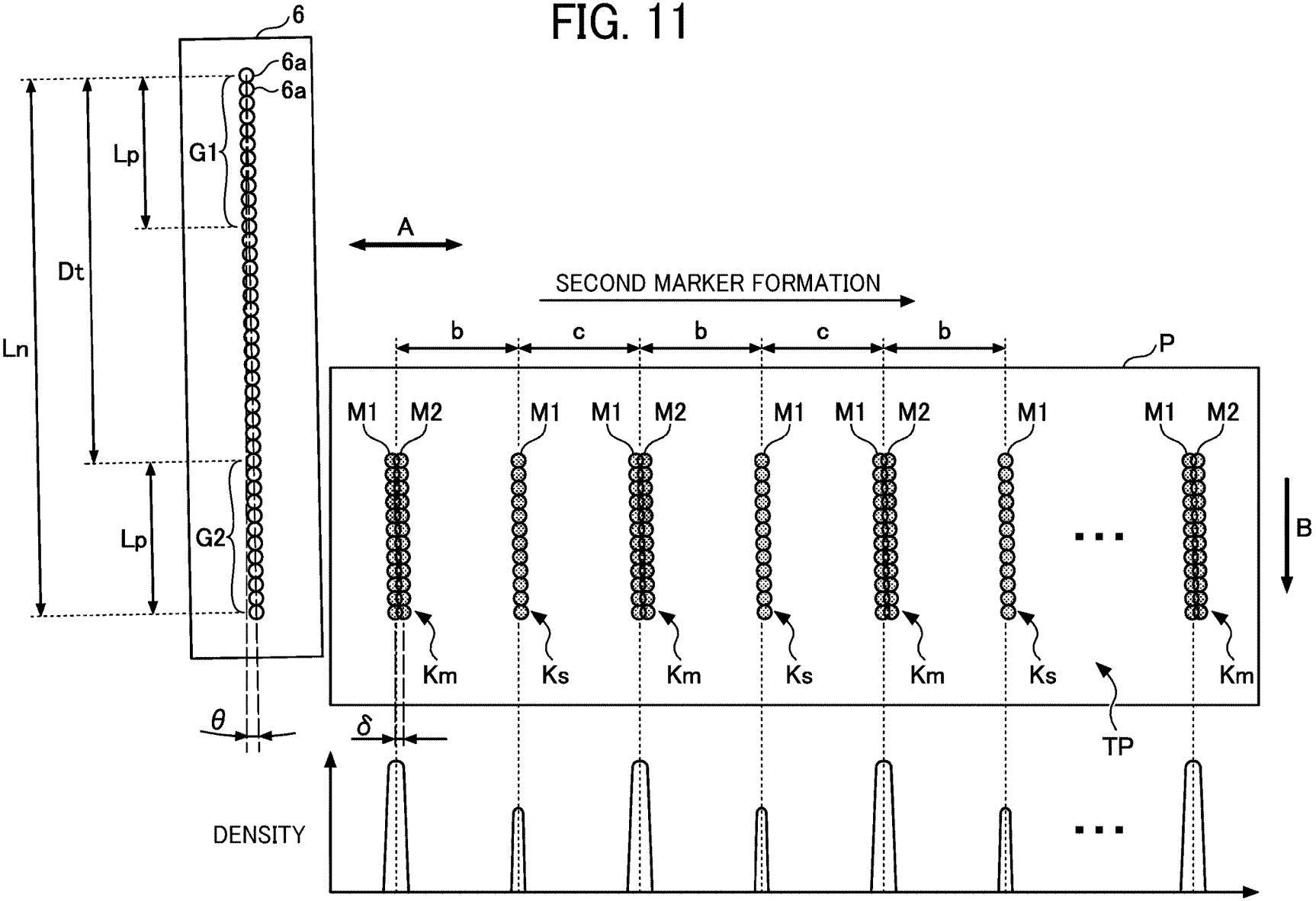
FIG. 11 is a diagram illustrating the second marker formed when the recording head is tilted.

FIG. 10 is a diagram illustrating the first markers M1 formed by the recording head 6 that is tilted. FIG. 11 is a diagram illustrating the second markers M2 formed by the recording head 6 that is tilted.

It is assumed that the recording head 6 is inclined to rotate on a plane parallel to the surface of the recording sheet P and has an inclination angle θ relative to the sub-scanning direction B. In this case, similarly, the patterns (dot rows) of the first marker M1 and the second marker M2 have an inclination angle θ relative to the sub-scanning direction B.

Further, as illustrated in FIG. 11, the first marker M1 and the second marker M2 are formed by different nozzle groups. Accordingly, when the recording head 6 is inclined, the first marker M1 and the second marker M2 are formed at deviated positions from each other in the main scanning direction A. Therefore, in this case, the measurement marker Km is formed by the first marker M1 and the second marker M2 that are partially overlapped, and the density distribution spreads in the main scanning direction A.

In FIG. 11, the first marker M1 and the second marker M2 are deviated from each other by a deviation amount δ in the main scanning direction A. The peak density position of the measurement marker Km in the main scanning direction A is an intermediate position between the first marker M1 and the second marker M2. Accordingly, the distances b and c are expressed by the following Equations 1 and 2, respectively.

$$b=a-\delta/2 \quad \text{Equation 1}$$

$$c=a+\delta/2 \quad \text{Equation 2}$$

When the ratio r is defined as being obtained by dividing the distance b by the distance c, that is, r=b/c, the deviation amount δ is expressed by the following Equation 3 based on the above Equations 1 and 2.

$$\delta=2a(1-r)/(1+r) \quad \text{Equation 3}$$

Using the deviation amount δ, the inclination angle θ is expressed by the following Equation 4.

$$\theta=\tan^{-1}(\delta/Dt) \quad \text{Equation 4}$$

The ratio calculation unit 405 calculates the ratio r based on the measured values of the distances b and c measured by the distance measurement unit 404 (S15).

The inclination calculation unit 402 calculates the inclination angle θ using the ratio r calculated by the ratio calculation unit 405, the ideal value a of the distance obtained from the pattern forming unit 400, and the conveyance distance Dt obtained from the conveyance control unit 401, based on Equations 3 and 4 (S16).

The information output unit 403 outputs and displays the information Inf representing the inclination angle θ on the panel display section or a display of the external PC (S17). The information Inf is, for example, the value of the inclination angle θ or a chart representing the inclination angle θ. Further, the information output unit 403 may cause the display unit or the like to indicate an error when the inclination angle θ exceeds a threshold.

A user can adjust the attachment position of the recording head 6 in the carriage 5 to eliminate the inclination of the recording head 6, referring to the information Inf representing the inclination angle θ presented on the display unit or the like.

As described above, the test pattern formation and the deviation detection operation of the present embodiment can provide accurate detection of the deviation amount in the image formation due to the inclination of the recording head relative to the carriage.

In the above-described embodiment, the user manually adjusts the attachment position of the recording head 6. Alternatively, the liquid discharge apparatus 1 can further includes an electric adjustment mechanism to adjust the position of the recording head 6 so that the adjustment mechanism automatically adjusts the attachment position of the recording head 6 based on the inclination angle θ.

Yet alternatively, the liquid discharge apparatus 1 may be configured to adjust the discharge timing of ink from the nozzles 6*a* without changing the position of the recording head 6, to minimize ink landing position deviations.

Figure 13:
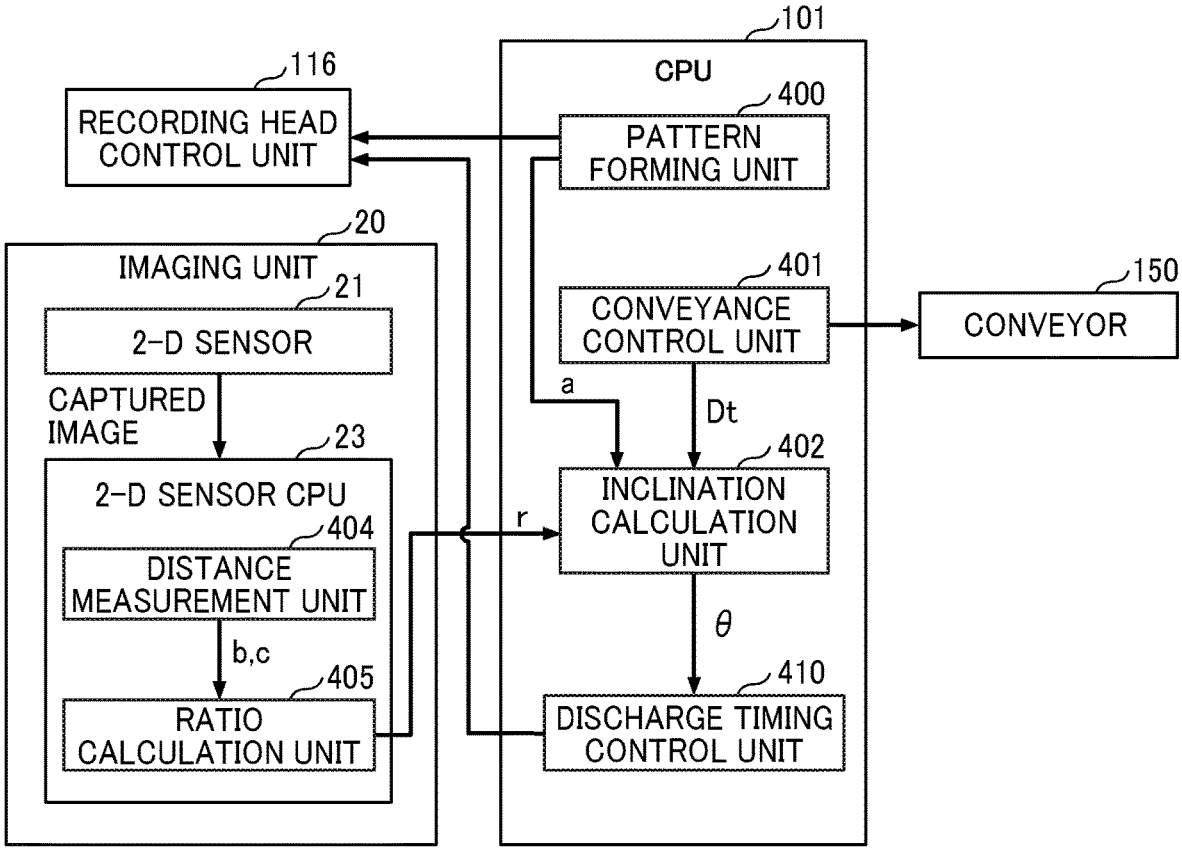
FIG. 13 is a block diagram illustrating a functional configuration relating to detection of deviations in landing position according to a variation.

FIG. 13 is a block diagram illustrating a functional configuration relating to detection of landing position deviations, according to a variation. In FIG. 13, instead of the information output unit 403, a discharge timing control unit 410 is implemented in the CPU 101. The discharge timing control unit 410 changes the discharge timing of ink from each nozzle 6*a* of the recording head 6, based on the inclination angle θ calculated by the inclination calculation unit 402, so that the inclination angle θ between the reference marker Ks and the measurement marker Km formed on the recording sheet P approaches zero (0). Specifically, the discharge timing control unit 410 gives an instruction to the recording head control unit 116 to change the value of the above-described discharge timing signal CHANGE based on the inclination angle θ, thereby adjusting the timing of the common drive waveform signal Vcom.

Figure 14:
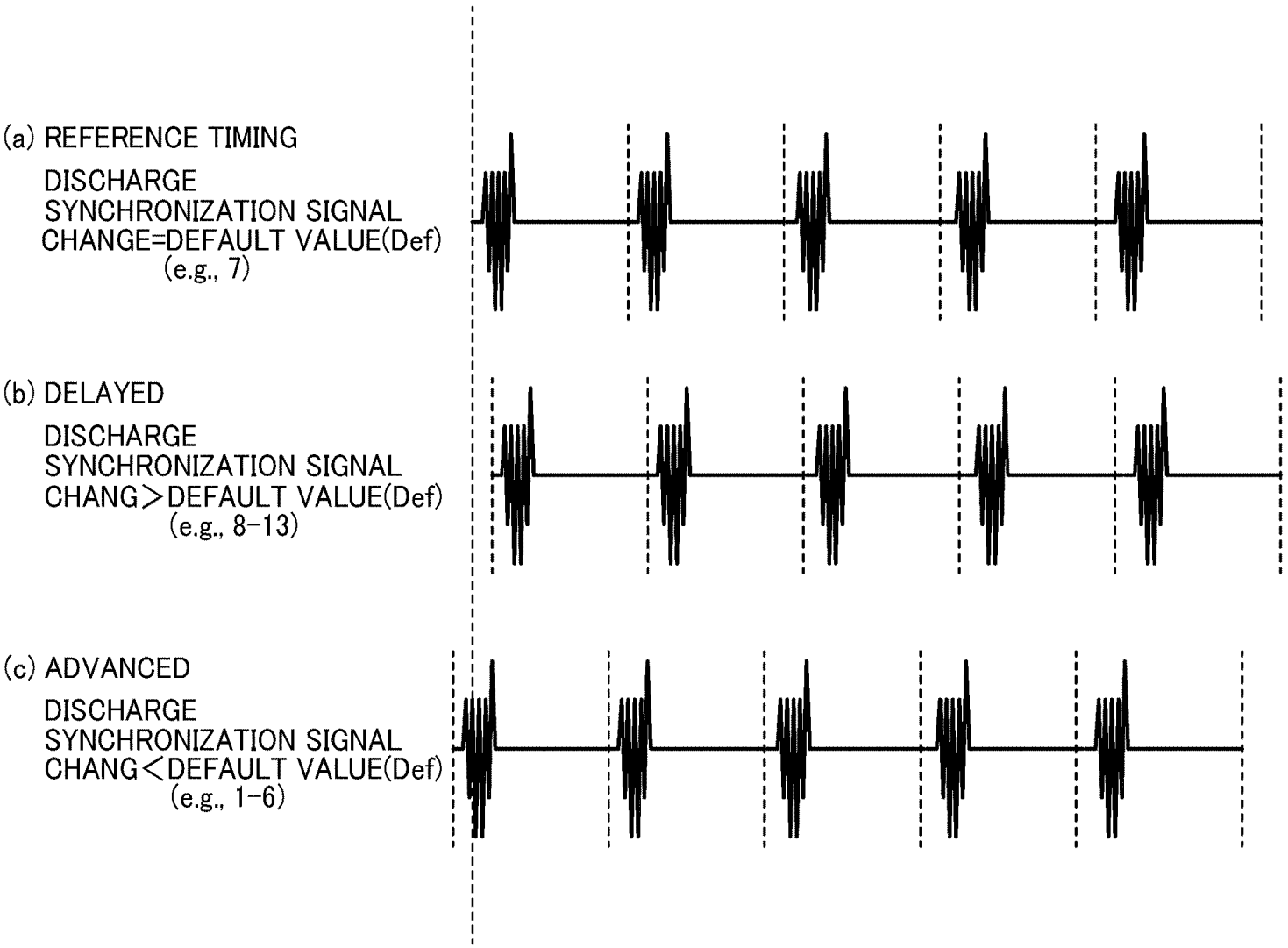
FIG. 14 is a diagram illustrating timing adjustment of a common drive waveform signal according to an embodiment.

FIG. 14 is a chart illustrating timing adjustment of the common drive waveform signal Vcom. When the discharge timing signal CHANGE has a default value, the common drive waveform is delayed by the default value from the LINE signal that is a reference signal. FIG. 14, a chart (a) illustrates the delay timing when the discharge timing signal CHANGE has the default value, and such a delay timing is set as the reference timing.

For example, when the default value of the delay amount is 7 as illustrated in the chart (a) in FIG. 14, to delay the discharge timing, the value of the discharge timing signal CHANGE is made greater than 7 (for example, 8 to 13) as illustrated in a chart (b) in FIG. 14.

By contrast, as illustrated in a chart (c) in FIG. 14, to advance the discharge timing, the value of the discharge timing signal CHANGE is made smaller than 7 (for example, 1 to 6). Such setting enables delicate adjustment of discharge timing in a unit of one dot or smaller.

In the above-described embodiment, the two-dimensional sensor 21 is used as the imaging device to capture the test pattern TP. However, what is necessary is to measure the distance between the reference marker Ks and the measurement marker Km in the main scanning direction. Therefore, the image device can be a one-dimensional sensor in which photoelectric conversion elements (for example, photodiodes) are arranged in the main scanning direction.

Yet alternatively, the imaging device can be a reflective photosensor including a light-emitting element and a light-receiving element, and the test pattern TP can be scanned with the reflective photosensor to acquire the above-mentioned captured image.

In the above embodiment, after the first marker M1 is formed, the recording sheet P is conveyed in the sub-scanning direction by the conveyor 150. Alternatively, the recording head 6 not the recording sheet P can be moved in the sub-scanning direction. That is, what is necessary is relatively moving the recording head 6 and the recording sheet P from each other in the sub-scanning direction in order to switch the plurality of nozzles 6*a* from the first nozzle group G1 used for forming the first marker M1 to the second nozzle group G2 used for forming the second marker M2.

In the above embodiment, the arrangement pitch of the second markers M2 in the main scanning direction is twice the arrangement pitch of the first markers M1. However, the magnification is not limited to 2 and may be any integral multiple. Furthermore, the first markers M1 and the second markers M2 are not necessarily formed at constant pitches (equal intervals) in the main scanning direction, and may be formed in a known pattern.

Furthermore, in the above-described embodiment, although the first markers M1 and the second markers M2 are each formed in linear form, the shape is not necessarily a linear form, and may be a group of discrete dots or one dot.

Second Embodiment

A liquid discharge apparatus according to a second embodiment is described below.

The liquid discharge apparatus according to the second embodiment can detect, instead of the above-described inclination of the recording head 6, an ink landing position deviation when the recording head 6 moves forward and backward.

Since the configuration of the liquid discharge apparatus according to the second embodiment is basically the same as the configuration of the liquid discharge apparatus 1 according to the first embodiment, description thereof will be omitted.

Figure 15:
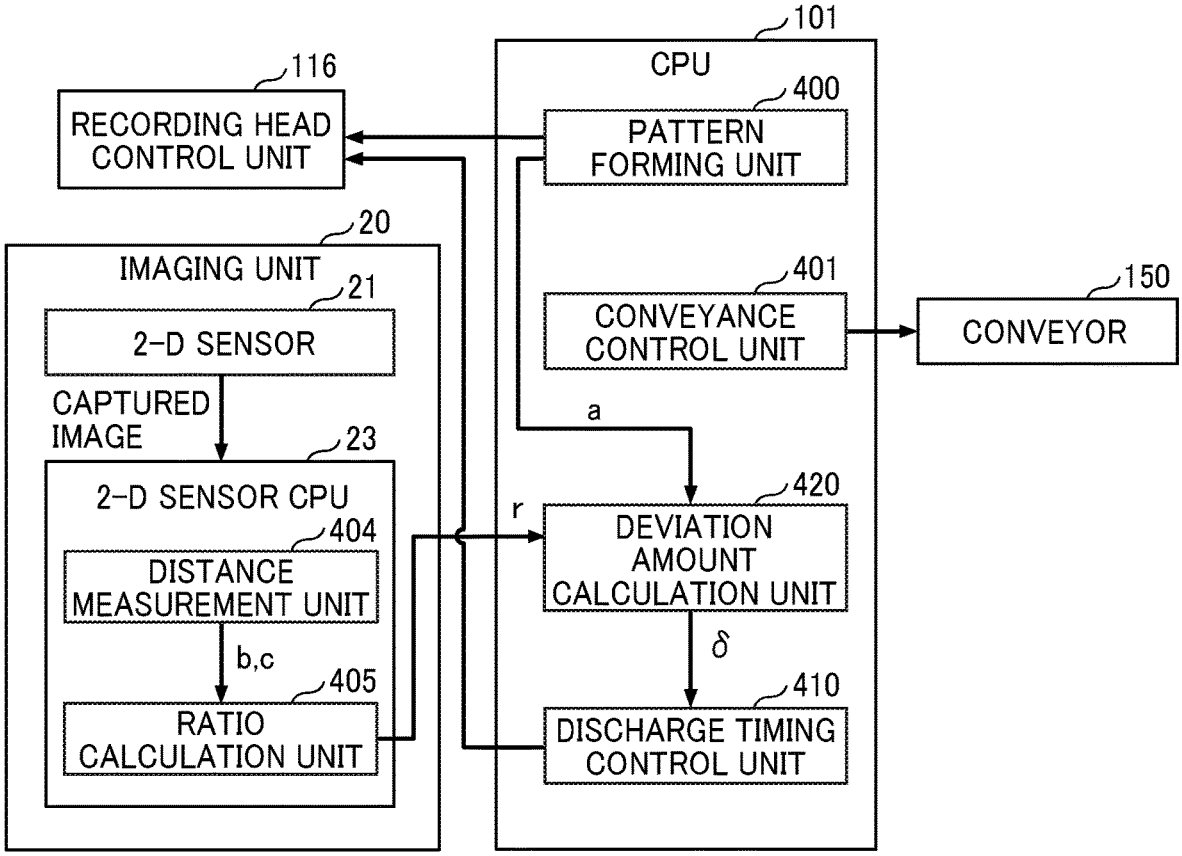
FIG. 15 is a block diagram illustrating a functional configuration relating to detection of deviations in landing position according to a second embodiment.

FIG. 15 is a block diagram illustrating a functional configuration relating to detection of deviations in landing position according to the second embodiment. The functional configuration according to the present embodiment is the same as the functional configuration illustrated in FIG. 13 except that a deviation amount calculation unit 420 is implemented instead of the inclination calculation unit 402.

Figure 16:
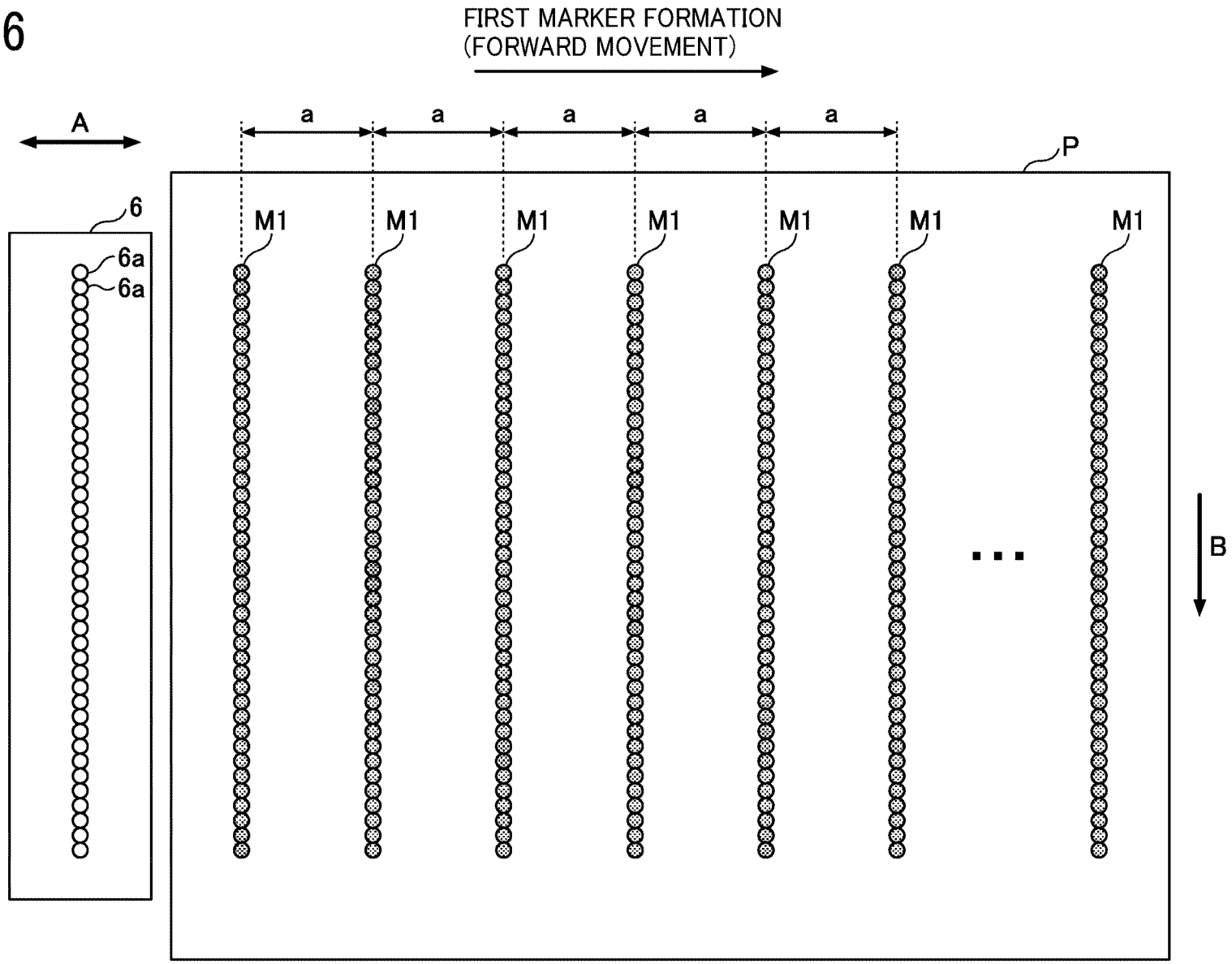
FIG. 16 is a diagram illustrating a first marker forming operation according to the second embodiment.
Figure 17:
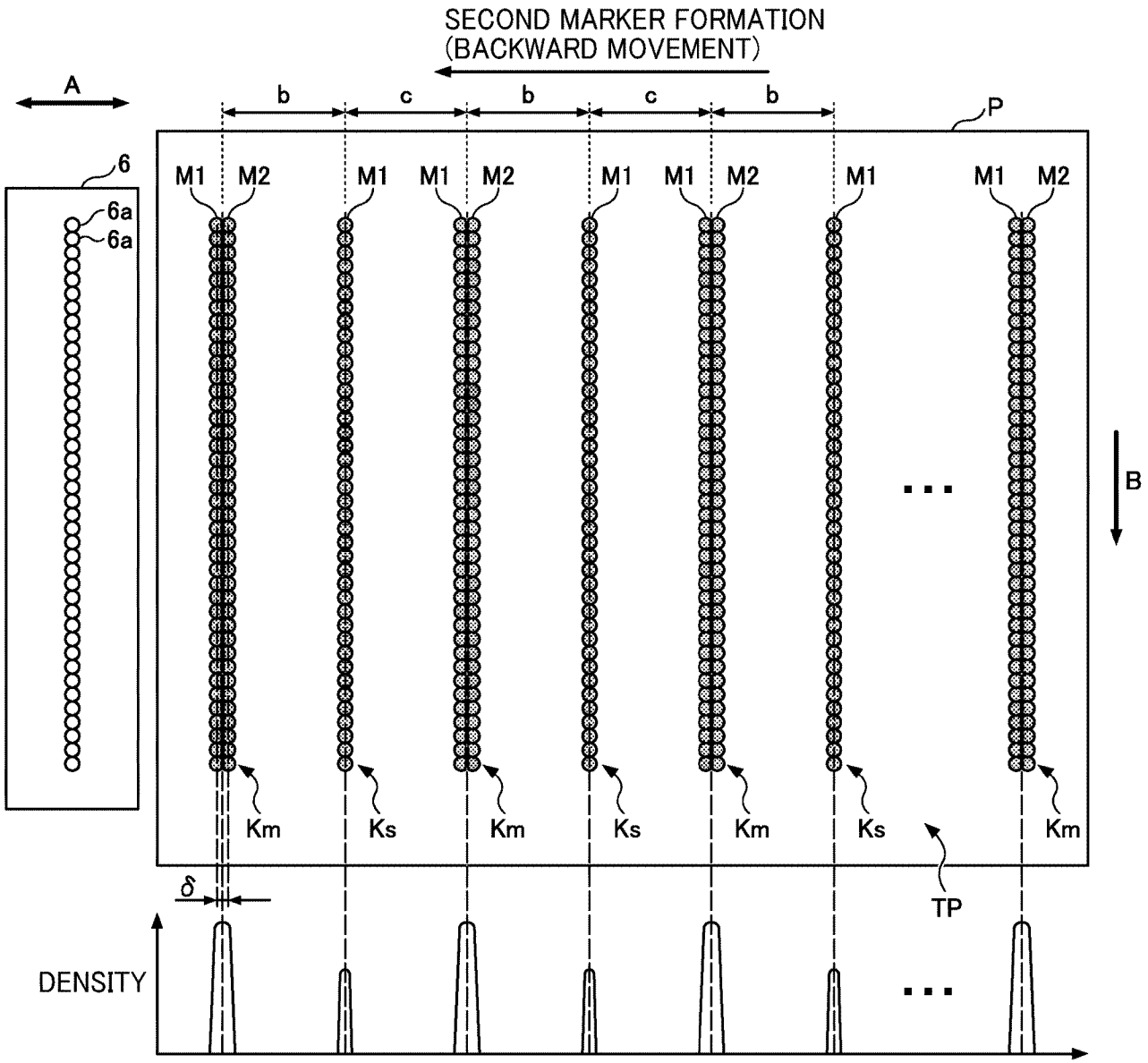
FIG. 17 is a diagram illustrating a second marker forming operation according to the second embodiment.
Figure 18:
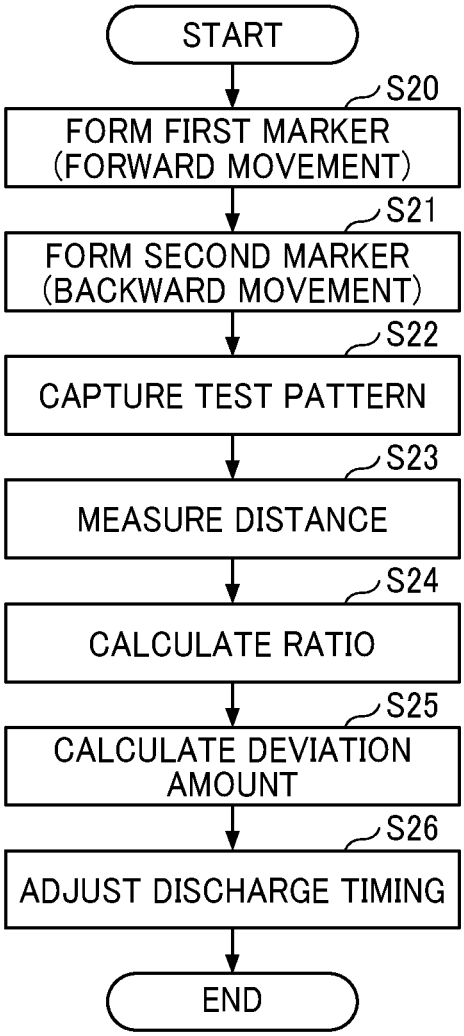
FIG. 18 is a flowchart illustrating test pattern formation and deviation detection operation according to the second embodiment.

Next, with reference to FIGS. 16 to 18, the formation of the test pattern TP and the detection of landing position deviation in the present embodiment are described.

FIG. 16 is a diagram illustrating the formation of the first markers M1. FIG. 17 is a diagram illustrating the formation of the second markers M2. FIG. 18 is a flowchart illustrating the formation of the test pattern TP and the detection of landing position deviation.

In the present embodiment, the test pattern TP is formed by a plurality of nozzles 6*a* constituting one nozzle row of the recording head 6. Note that the test pattern TP may be formed by some of the nozzles 6*a* in one nozzle row. Further, as in the first embodiment, the color of the ink forming the test pattern TP is not limited to black.

First, as illustrated in FIG. 16, while moving the recording head 6 from the predetermined start position to the positive side (forward direction) in the main scanning direction A, the pattern forming unit 400 causes the recording head 6 to discharge ink from the plurality of nozzles 6*a* to the recording sheet P, thereby forming the first markers M1 (S20 in FIG. 18). In the present embodiment, the pattern forming unit 400 forms the first markers M1 at a constant pitch in the main scanning direction A. In an ideal state in which no deviation is present in the ink landing position, the first markers M1 are formed at intervals of the ideal value a in the main scanning direction A.

In the present embodiment, the recording sheet P is not conveyed after the first markers M1 are formed. Then, as illustrated in FIG. 17, while moving the recording head 6 to the negative side (return direction) in the main scanning direction A, the pattern forming unit 400 causes the recording head 6 to discharge the ink from the plurality of nozzles 6*a* to the recording sheet P, thereby forming the second markers M2 (S21). At this time, the pattern forming unit 400 forms the second markers M2 at positions reduced, with a predetermined thinning rate (for example, 2), from a plurality of positions where the first markers M1 are formed. In the present embodiment, the pattern forming unit 400 forms the second markers M2 with a pitch twice as large as that of the first marker M1 so that the second markers M2 overlap with some of the first markers M1. In an ideal state in which there is no deviation in the ink landing position, the second markers M2 fully lap over some of the first markers M1.

Similar to the first embodiment, the test pattern TP formed on the recording sheet P includes the reference marker Ks formed with the first marker M1 and the measurement marker Km in which the first marker M1 and the second marker M2 are overlaid.

FIG. 17 illustrates a case where a positional deviation occurs in the ink landing position between the forward movement and the backward movement, and the ink landing position has a deviation amount δ in the main scanning direction A.

The test pattern TP is captured by the two-dimensional sensor 21, and the captured image is input to the two-dimensional sensor CPU 23 (S22).

The distance measurement unit 404 performs the same processing as in the first embodiment based on the captured image, thereby measuring the distance b between the reference marker Ks and the first measurement marker and the distance c between the reference marker Ks and the second measurement marker (S23).

The ratio calculation unit 405 calculates the ratio r (=b/c) based on the measured values of the distances b and c measured by the distance measurement unit 404 (S24).

Using the ratio r calculated by the ratio calculation unit 405 and the ideal value a of the interval obtained from the pattern forming unit 400, the deviation amount calculation unit 420 calculates the deviation amount δ based on the above Equation 3 (S25).

The discharge timing control unit 410 changes the discharge timing of ink from each nozzle 6*a* of the recording head 6 based on the deviation amount δ calculated by the deviation amount calculation unit 420, so that the deviation amount δ approaches zero (0). The timing adjustment method by the discharge timing control unit 410 is the same as that in the first embodiment.

As described above, with the formation of the test pattern TP and the detection of landing position deviation according to the present embodiment, the deviation amount in the image formation caused by the reciprocating movement of the recording head 6 can be detected with high accuracy.

The second embodiment can be modified in the same manner as in the first embodiment. For example, the imaging device (an image capture device) and an arrangement pitch of the second markers relative to the arrangement pitch of the first markers can be modified.

Further, the liquid discharge apparatus can be configured to perform both the formation of the test pattern TP and the deviation detection operation in the first embodiment and the second embodiment.

Next, as a variation of the first embodiment and the second embodiment, a description is given below of an example in which the test pattern TP is surrounded with a reference frame F.

Figure 19:
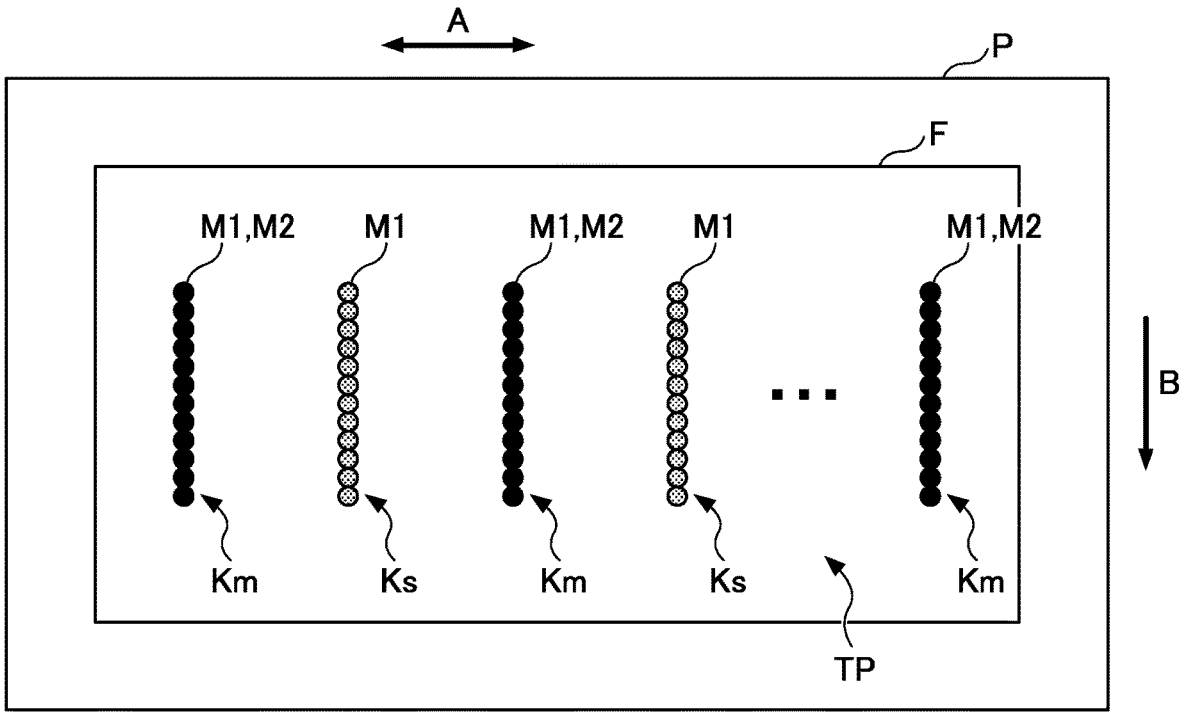
FIG. 19 illustrates an example of a test pattern and a reference frame.

FIG. 19 illustrates an example of the test pattern TP and the reference frame F. The reference frame F is formed on the recording sheet P by the processing of the pattern forming unit 400. The reference frame F is formed with a thicker line than the test pattern TP, for example. The two-dimensional sensor 21 captures the test pattern TP and the reference frame F.

Figure 20:
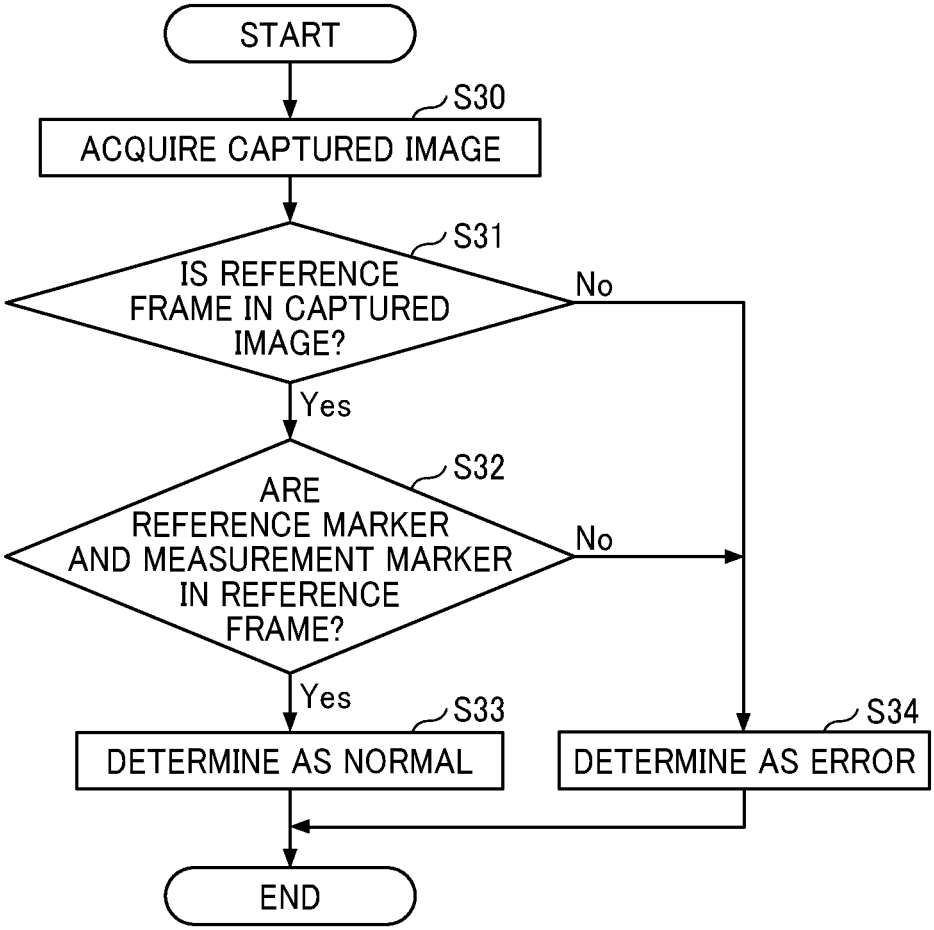
FIG. 20 is a flowchart illustrating a determination process based on a reference frame according to an embodiment.

The distance measurement unit 404 uses the reference frame F when measuring the distance between the reference marker Ks and the measurement marker Km based on the captured image. Specifically, the distance measurement unit 404 performs a determination process based on the reference frame F illustrated in FIG. 20. First, the distance measurement unit 404 acquires the captured image captured by the two-dimensional sensor 21 (S30). Next, the distance measurement unit 404 analyzes the captured image and determines whether or not the reference frame F is present in the captured image (S31). When the reference frame F is present (S31: Yes), the distance measurement unit 404 determines whether or not the reference marker Ks and the measurement marker Km are present in the reference frame F (S32). When the reference marker Ks and the measurement marker Km are present (S32: Yes), the distance measurement unit 404 determines the detection result as normal (S33).

On the other hand, when the reference frame F is not present in the captured image (S31: No) or the reference marker Ks and the measurement marker Km are not present in the reference frame F (S32: No), the distance measurement unit 404 determines the detection result as abnormal, that is, error, (S34).

In response to the determination as normal, the distance measurement unit 404 measures the distance between the reference marker Ks and the measurement marker Km. On the other hand, in response to the determination as abnormal, the distance measurement unit 404 ends the process.

Since the distance measurement unit 404 detects the positions of the reference marker Ks and the measurement marker Km based on the position of the reference frame F, the distance measurement unit 404 can easily detect the reference marker Ks and the measurement marker Km even when the position of the test pattern TP deviates.

The reference frame F and the test pattern TP can be formed in any order. The reference frame F can be formed before the test pattern TP is formed or after the test pattern TP is formed.

In the first embodiment and the second embodiment, the test pattern TP including at least one reference marker and one measurement marker can suffice. Further, the ratio calculation unit 405 is not essential, and the deviation amount δ and the inclination angle θ can be calculated based on the measured value of the distance between the reference marker and the measurement marker.

Although the liquid discharge apparatus is an inkjet printer in the above embodiments, the aspects of the present disclosure can be applied to a three-dimensional (3D) printer or the like, not limited to an inkjet printer.

The liquid discharge apparatus may have the following configuration, for example.

Figure 21:
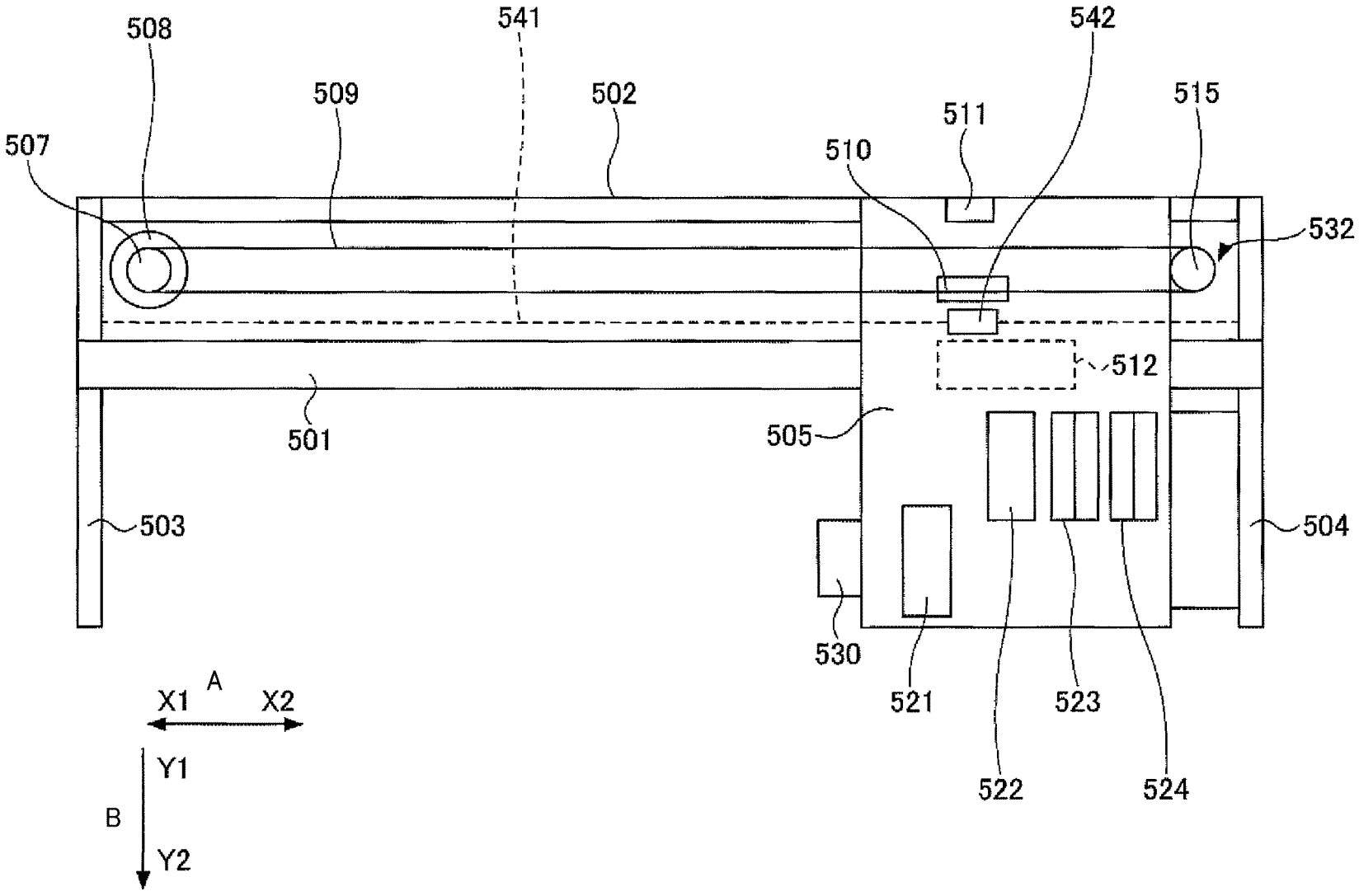
FIG. 21 is an example of a diagram illustrating a carriage according to an embodiment.

FIG. 21 is an example of a diagram illustrating the operation of the carriage in more detail. In this example, a guide rod 501 and a sub guide 502 span between a left side plate 503 and a right side plate 504. A bearing 512 and a sub guide receiving portion 511 hold a carriage 505 to slide on the guide rod 501 and the sub guide 502, and the carriage 505 can move in the directions indicated by arrows X1 and X2 (the main scanning direction A).

On the carriage 505, recording heads 521 and 522 that discharge black (K) ink droplets, and recording heads 523 and 524 that discharge ink droplets of cyan (C), magenta (M), and yellow (Y) are mounted. The recording head 521 is provided because black is frequently used. However the recording head 521 can be omitted.

The recording heads 521 to 524 can be of any of the following types: a piezo type in which, as a pressure generator (an actuator) to pressurize ink in an ink flow channel, a piezoelectric element deforms a diaphragm forming a wall face of the ink flow channel to vary the inner volume of the ink flow channel to discharge ink droplets; a thermal type in which a heat element heats an ink in an ink flow channel to generate bubbles, thereby discharging ink droplets with pressure; and an electrostatic type in which a diaphragm forming a wall face of an ink flow channel and an electrode are facing each other and an electrostatic force generated between the diaphragm and the electrode deforms the diaphragm to vary the inner volume of the ink flow channel to discharge droplets of the ink.

A main scanning assembly 532 that moves the carriage 505 includes a main scanning motor 508 disposed on one side in the main scanning direction, a driving pulley 507 rotated by the main scanning motor 508, a pressure roller 515 disposed on the other side in the main scanning direction, and a timing belt 509 that is wound between the driving pulley 507 and the pressure roller 515. The pressure roller 515 is tensioned outward (in a direction away from the driving pulley 507) by a tension spring.

A part of the timing belt 509 is secured to and held by a belt holding portion 510 provided on the back side of the carriage 505, so that the carriage 505 is pulled in the main scanning direction with the rotation of the timing belt 509.

Further, an encoder sheet 541 is provided along the main scanning direction of the carriage 505, and an encoder sensor 542 is disposed on the carriage 550 to read a slit of the encoder sheet 541. With this structure, the position of the carriage 505 in the main scanning direction can be detected. When the carriage 505 is present in a recording area of a main scanning region, a sheet feed mechanism intermittently conveys a sheet in the directions indicated by arrows Y1 and Y2 (the sub-scanning direction B) perpendicular to the main scanning direction of the carriage 5.

In the liquid discharge apparatus (an image forming apparatus) according to the present embodiment, the carriage 505 moves in the main scanning direction. Then, while the sheet is intermittently fed, the recording heads 521 to 524 are driven according to image data to discharge droplets, thereby forming a desired image on the sheet and creating a printed matter.

On one side face of the carriage 505, a print position deviation sensor 530 to detect a deviation of the landing position (to read a test pattern) is mounted. The print position deviation sensor 530 includes a light-emitting element such as a light emitting diode (LED) and a light-receiving element such as a reflective photosensor to read a test pattern for landing position detection, formed on the sheet.

Since the print position deviation sensor 530 is for the recording head 521, preferably, another print position deviation sensor 530 is mounted in parallel to the recording heads 522 to 524 in order to adjust the liquid discharge timing (droplet discharge timing) of the recording heads 522 to 524. Alternatively, the carriage 505 may be equipped with a mechanism to slide the print position deviation sensor 530 so as to be in parallel to the recording heads 522 to 524. In such a structure, with a single print position deviation sensor 530, liquid discharge timings from the recording heads 522 to 524 can be adjusted. Alternatively, even when the image forming apparatus sends the sheet in the reverse direction, the liquid discharge timings of the recording heads 522 to 524 can be adjusted with a single print position deviation sensor 530.

Figure 22:
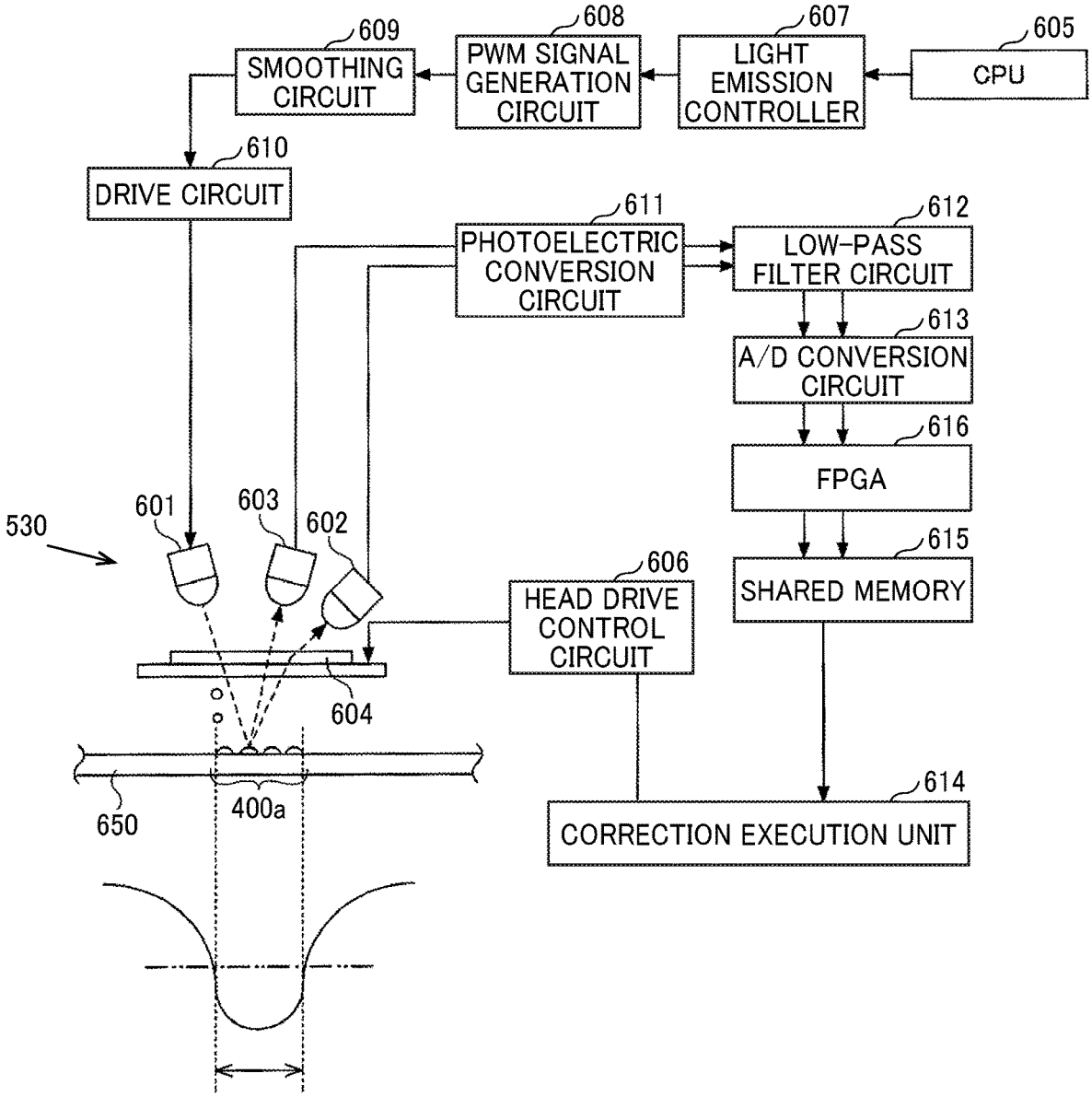
FIG. 22 is a schematic diagram illustrating an example of a configuration for detection of an edge of the test pattern according to an embodiment.

FIG. 22 is a schematic diagram illustrating an example of a configuration for the print position deviation sensor to detect edges of the test pattern. FIG. 22 is a view of the recording head 521 and the print position deviation sensor 530 illustrated in FIG. 21 as viewed from the right side plate 504.

The print position deviation sensor 530 includes a light-emitting element 601, a light-receiving element 602, and a light-receiving element 603 arranged in a direction orthogonal to the main scanning direction. The arrangement of the light-emitting element 601 and the light-receiving elements 602 and 603 may be reversed. The light-emitting element 601 projects spot light onto a test pattern 400*a* on a sheet 650. One of the light-receiving elements 602 and 603 receives specularly reflected light reflected by the sheet 650, and the other receives diffusely reflected light such as light reflected from a platen and other scattered light. The light-emitting element 601 and the light-receiving elements 602 and 603 are secured to the inner side of a housing. Further, the surface of the print position deviation sensor 530 that faces the platen is shielded from the outside by a lens 604 or the like. Thus, the print position deviation sensor 530 is packaged and can be distributed alone.

In the print position deviation sensor 530, the light-emitting element 601, the light-receiving element 602, and the light-receiving element 603 are arranged in a direction (parallel to the sub-scanning direction) orthogonal to the scanning direction of the carriage 505. Thus, the influence on the detection result by the movement speed fluctuations of the carriage 505 can be reduced.

For example, an LED can be used as the light-emitting element 601, but any light source (for example, a laser or various lamps) capable of projecting visible light can be used. The reason for use of visible light is an expectation that the spot light is absorbed by the test pattern. Although the wavelength of the light-emitting element 601 is fixed in this example, alternatively, a plurality of print position deviation sensors 530 including light-emitting elements 601 having different wavelengths can be used.

Further, the diameter of spot light formed by the light-emitting element 601 is in millimeter-order to use an inexpensive lens not a lens with a high accuracy. The diameter of spot light relates to the edge detection accuracy of the test pattern. With the detection method according to the present embodiment, the edge position can be detected with sufficiently high accuracy even in millimeter-order. However, the diameter of spot light can be made smaller.

The CPU 605 starts landing position deviation correction at a predetermined timing. That is, the landing position deviation correction is triggered by, for example, an instruction from a user to correct the landing position deviation input from the operation and display unit; a determination, made by the CPU 605, that the sheet 650 is a specific sheet based on a detection that the intensity of reflection of light emitted by the light-emitting element 601 before ink discharge is predetermined value or lower; or a determination that a change equal to or greater than a threshold in temperature or humidity from the temperature or humidity detected in a last landing position deviation correction and stored. Alternatively, the landing position deviation correction can be performed at regular timings (daily, weekly, monthly etc.).

In the landing position deviation correction according to the present embodiment, processing is performed in two stages before and after the test pattern is formed. However, since the main difference is whether or not a test pattern is formed, a case where a test pattern is formed is described here.

The CPU 605 instructs a main scanning driver or the like to reciprocate the carriage 505. The CPU 605 further instructs a head drive control circuit 606 to discharge ink droplets according to print data of a predetermined test pattern. The main scanning driver causes the carriage 505 to reciprocate in the main scanning direction with respect to the sheet 650. The head drive control circuit 606 discharges droplets from the recording head 521 to form the test pattern 400*a* including at least two independent lines.

In addition, the CPU 605 performs processing for reading of the test pattern 400*a* on the sheet 650 by the print position deviation sensor 530. Specifically, the CPU 605 sets, in a light emission controller 607, a PWM value (mainly duty) for driving the light-emitting element 601 of the print position deviation sensor 530. Then, the light emission controller 607 generates, in a PWM signal generation circuit 608, a PWM signal corresponding to the PWM value. The PWM signal generated by the PWM signal generation circuit 608 is smoothed by a smoothing circuit 609 and supplied to a drive circuit 610. The drive circuit 610 drives the light-emitting element 601 to emit spot light to the test pattern 400*a* on the sheet 650. The light emission controller 607, the smoothing circuit 609, the drive circuit 610, a photoelectric conversion circuit 611, a low-pass filter circuit 612, an A/D conversion circuit 613, and a correction execution unit 614 are mounted on a main control unit or a control unit. The shared memory 615 is, for example, a RAM.

As the light-emitting element 601 irradiates the test pattern 400*a* on the sheet 650 with the spot light, the light reflected from the test pattern enters the light-receiving elements 602 and 603. The light-receiving elements 602 and 603 output an intensity signal of the reflected light to the photoelectric conversion circuit 611. The photoelectric conversion circuit 611 can switch magnification registers of the light-receiving elements 602 and 603 as described later. The magnification register increases the output voltage of the light-receiving elements 602 and 603 according to the set value, for example, in 4 to 16 bits. For example, in the case of 4 bits, "0001" instructs a normal output voltage. When "0010" is set, the output voltage is doubled, and when "0011" is set, the output voltage is tripled. Alternatively, any magnification can be set. For example, the output voltage is 1.5 times as large as the normal output voltage when "0010" is set, and the output voltage is doubled when "0011" is set. Thus, the sensitivity of the light-receiving elements 602 and 603 can be increased by increasing the magnification.

Specifically, the photoelectric conversion circuit 611 photoelectrically converts the intensity signal and outputs a photoelectric conversion signal (sensor output voltage) to the low-pass filter circuit 612. The low-pass filter circuit 612 removes high-frequency noise and then outputs the photoelectric conversion signal to the A/D conversion circuit 613. The A/D conversion circuit 613 performs A/D conversion on the photoelectric conversion signal and outputs a converted signal to a signal processing circuit (such as a FPGA 616). The signal processing circuit stores, in the shared memory 615, output voltage data, which is a digital value of the output voltage after the A/D conversion.

The correction execution unit 614 reads the output voltage data stored in the shared memory 615, corrects the landing position deviation, and sets a head drive data in the head drive control circuit 606. That is, the correction execution unit 614 detects edge positions of the test pattern 400*a* and compares the edge positions with the appropriate distance between the two lines, thereby calculating the landing position deviation amount. The correction execution unit 614 is implemented by the CPU 605 executing a program or an integrated circuit (IC) or the like.

The correction execution unit 614 calculates the correction amount of the liquid discharge timing for driving the recording head so that the landing position deviation is eliminated. Then, the correction execution unit 614 sets the calculated correction amount of the liquid discharge timing in the head drive control circuit 606. Further, the correction execution unit 614 performs sensor correction, the description of which is deferred. Thus, the head drive control circuit 606 drives the recording head with the drive data in which the liquid discharge timing is corrected based on the correction amount, to minimize deviations in the droplet landing position.

The sensor is not limited to the example described above, and the sensor serving as the reading device may be a one-dimensional sensor or a two-dimensional sensor as long as the position where the liquid has landed can be read based on a pattern such as a test pattern.

The reading device preferably has an image capture capability. That is, for example, the reading device is implemented by an optical sensor or the like. On the other hand, as long as the reading device can read a pattern such as a marker, the reading device may be implemented by a reading device implemented by another type sensor than the optical sensor, or a combination of the optical sensor and another type sensor.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a recording head configured to discharge a liquid to form a pattern on a recording medium;

a reading device configured to read the pattern; and circuitry configured to:

form a plurality of first markers including at least two first markers at a constant pitch while moving the recording head relative to the recording medium in a head movement direction;

form a plurality of second markers at a pitch that is an integral multiple of the constant pitch of the plurality of first markers to form the plurality of second markers at some positions of the plurality of first markers, the plurality of second markers including a second marker overlaid with one of the at least two first markers to form a pattern including a reference marker formed with one of the at least two first markers and a measurement marker in which the second marker is overlaid on another of the at least two first markers; and measure a distance between the reference marker and the measurement marker in the head movement direction based on information obtained by the reading device.

2. The liquid discharge apparatus according to claim 1, wherein the pitch of the plurality of second markers is twice the pitch of the plurality of first markers, and wherein the reference marker is interposed between a pair of measurement markers including the measurement marker.

3. The liquid discharge apparatus according to claim 2, wherein the circuitry is configured to:

measure a first distance between the reference marker and one of the pair of measurement markers;

measure a second distance between the reference marker and the other of the pair of measurement markers; and calculate a ratio between the first distance and the second distance.

4. The liquid discharge apparatus according to claim 3, wherein, when the head movement direction is referred to as a first direction, the recording head includes a plurality of nozzles lined in a second direction orthogonal to the first direction, the plurality of nozzles configured to discharge the liquid, and wherein the circuitry is configured to form the plurality of first markers and the plurality of second markers with the liquid discharged from same nozzles of the plurality of nozzles.

5. The liquid discharge apparatus according to claim 4, wherein the circuitry is configured to:

form the plurality of first markers while moving the recording head to a positive side in the first direction;

form the plurality of second markers while moving the recording head to a negative side in the first direction; and calculate a deviation amount between said another of the at least two first markers and the second marker in the first direction using the ratio and the pitch of the plurality of first markers.

6. The liquid discharge apparatus according to claim 5, wherein the circuitry is configured to adjust a discharge timing of the liquid from the recording head based on the deviation amount.

7. The liquid discharge apparatus according to claim 4, wherein the circuitry is configured to form each of the plurality of first markers and the plurality of second markers in a linear shape extending in the second direction.

8. The liquid discharge apparatus according to claim 3, wherein, when the head movement direction is referred to as a first direction, the recording head includes a plurality of nozzles lined in a second direction orthogonal to the first direction, the plurality of nozzles configured to discharge the liquid, and wherein the circuitry is configured to form the plurality of first markers and the plurality of second markers with the liquid discharged from different nozzles of the plurality of nozzles.

9. The liquid discharge apparatus according to claim 8, further comprising a conveyor configured to move the recording medium relative to the recording head in the second direction, wherein the circuitry is configured to:

cause the conveyor to move the recording medium by a predetermined movement amount relative to the recording head after the plurality of first markers is formed; and form the plurality of second markers after the recording medium is moved relative to the recording head.

10. The liquid discharge apparatus according to claim 9, wherein the circuitry is configured to calculate an inclination angle of the recording head using the ratio, the pitch of the plurality of first markers, and the predetermined movement amount.

11. The liquid discharge apparatus according to claim 10, wherein the circuitry is configured to output information representing the inclination angle.

12. The liquid discharge apparatus according to claim 10, wherein the circuitry is configured to adjust a discharge timing of the liquid from the recording head based on the inclination angle.

13. The liquid discharge apparatus according to claim 1, wherein the circuitry is configured to form a reference frame to surround the pattern.

14. The liquid discharge apparatus according to claim 1, wherein the reading device includes an image capture device.

15. The liquid discharge apparatus according to claim 14, wherein the circuitry is configured to:

measure a distance between peaks in the head movement direction in a density distribution of a captured image captured by the image capture device; and obtain the distance between the reference marker and the measurement marker based on the distance between the peaks.

16. A liquid discharge method comprising:

forming, with a liquid discharged from a recording head, a plurality of first markers including at least two first markers at a constant pitch while moving the recording head relative to a recording medium in a head movement direction;

forming a plurality of second markers at a pitch that is an integral multiple of the constant pitch of the plurality of first markers to form the plurality of second markers at some positions of the plurality of first markers, the plurality of second markers including a second marker overlaid with one of the at least two first markers to form a pattern including a reference marker formed with one of the at least two first markers and a measurement marker in which the second marker is overlaid on another of the at least two first markers;

reading, with a sensor, the pattern; and measure a distance between the reference marker and the measurement marker in the head movement direction based on information obtained by the reading.

17. A non-transitory recording medium storing a plurality of program codes which, when executed by one or more processors, causes the processors to perform a method, the method comprising:

forming, with a liquid discharged from a recording head, a plurality of first markers including at least two first markers at a constant pitch while moving the recording head relative to a recording medium in a head movement direction;

forming a plurality of second markers at a pitch that is an integral multiple of the constant pitch of the plurality of first markers to form the plurality of second markers at some positions of the plurality of first markers, the plurality of second markers including a second marker overlaid with one of the at least two first markers to form a pattern including a reference marker formed with one of the at least two first markers and a measurement marker in which the second marker is overlaid on another of the at least two first markers;

reading, with a sensor, the pattern; and measure a distance between the reference marker and the measurement marker in the head movement direction based on information obtained by the reading.

* * * * *